US009314838B2

(12) United States Patent
Pointon et al.

(10) Patent No.: US 9,314,838 B2
(45) Date of Patent: Apr. 19, 2016

(54) METHOD OF MANUFACTURING A COOLED TURBINE BLADE WITH DENSE COOLING FIN ARRAY

(71) Applicant: Solar Turbines Incorporated, San Diego, CA (US)

(72) Inventors: Stephen Edward Pointon, Santee, CA (US); Andrew Meier, San Diego, CA (US); Nnawuihe Asonye Okpara, San Diego, CA (US); Daniel Martinez, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 846 days.

(21) Appl. No.: 13/631,043

(22) Filed: Sep. 28, 2012

(65) Prior Publication Data

US 2014/0093387 A1 Apr. 3, 2014

(51) Int. Cl.

| | |
|---|---|
| ***B22C 9/10*** | (2006.01) |
| ***F01D 5/18*** | (2006.01) |
| ***B22C 7/02*** | (2006.01) |
| ***B22C 9/04*** | (2006.01) |

(52) U.S. Cl.

CPC ... *B22C 9/10* (2013.01); *B22C 7/02* (2013.01); *B22C 9/04* (2013.01); *B22C 9/043* (2013.01); *B22C 9/108* (2013.01); *F01D 5/187* (2013.01); *F05D 2230/21* (2013.01); *F05D 2240/126* (2013.01); *F05D 2240/127* (2013.01); *F05D 2250/185* (2013.01); *F05D 2260/22141* (2013.01); *Y10T 29/49339* (2015.01); *Y10T 29/49341* (2015.01)

(58) Field of Classification Search

CPC ..... B22C 9/10; B22C 9/108; B22C 9/04; B22C 7/02; B22C 9/043; B22C 9/103; F01D 5/187; F05D 2250/185; F05D 2240/126; F05D 2240/127; F05D 2230/21; F05D 2260/22141

See application file for complete search history.

(56) References Cited

U.S. PATENT DOCUMENTS

| | | | | | |
|---|---|---|---|---|---|
| 2,948,935 | A | * | 8/1960 | Carter | B22C 1/165 164/518 |
| 3,017,159 | A | * | 1/1962 | Foster | F01D 5/147 416/219 R |
| 3,806,274 | A | | 4/1974 | Moore | |
| 4,321,010 | A | * | 3/1982 | Wilkinson | B22C 9/04 416/92 |
| 4,604,031 | A | | 8/1986 | Moss et al. | |
| 4,786,233 | A | * | 11/1988 | Shizuya | F01D 5/187 416/90 R |

(Continued)

FOREIGN PATENT DOCUMENTS

| | | |
|---|---|---|
| GB | 1404757 | 9/1975 |
| GB | 2355017 A | 4/2001 |

*Primary Examiner* — Dwayne J White
*Assistant Examiner* — Eldon Brockman
(74) *Attorney, Agent, or Firm* — Procopio, Cory, Hargreaves & Savitch LLP

(57) ABSTRACT

A method of manufacturing a cooled turbine blade for use in a gas turbine engine. The method includes forming an inner blade pattern, the inner blade pattern including an inner spar and a plurality of inner spar cooling fins. The method also includes forming an inner blade core, removing the inner blade pattern from the inner blade core, forming an outer blade pattern, forming a casting shell, removing the outer blade pattern from the casting shell, and casting the cooled turbine blade in the casting shell. The method also includes removing the casting shell from the cast cooled turbine blade, and removing the inner blade core from the cast cooled turbine blade.

22 Claims, 11 Drawing Sheets

(56) References Cited

U.S. PATENT DOCUMENTS

| | | | | |
|---|---|---|---|---|
| 4,820,123 | A | 4/1989 | Hall | |
| 5,813,835 | A | 9/1998 | Corsmeier et al. | |
| 5,820,774 | A * | 10/1998 | Dietrich | B22C 9/10 164/369 |
| 6,350,404 | B1 | 2/2002 | Li et al. | |
| 6,382,907 | B1 | 5/2002 | Bregman et al. | |
| 6,557,621 | B1 | 5/2003 | Dierksmeier et al. | |
| 6,626,230 | B1 | 9/2003 | Woodrum et al. | |
| 6,637,500 | B2 * | 10/2003 | Shah | B22C 9/04 148/404 |
| 6,720,028 | B1 | 4/2004 | Haaland | |
| 6,951,239 | B1 * | 10/2005 | Snyder | B22C 9/043 164/35 |
| 7,033,136 | B2 | 4/2006 | Botrel et al. | |
| 7,118,325 | B2 | 10/2006 | Kvasnak et al. | |
| 7,210,906 | B2 * | 5/2007 | Papple | F01D 5/187 416/1 |
| 7,240,718 | B2 * | 7/2007 | Schmidt | B22C 9/04 134/166 R |
| 7,278,460 | B2 | 10/2007 | Grunstra et al. | |
| 7,302,991 | B2 | 12/2007 | Chang et al. | |
| 7,413,407 | B2 * | 8/2008 | Liang | F01D 5/186 416/97 R |
| 7,600,973 | B2 | 10/2009 | Tibbott et al. | |
| 7,674,092 | B2 | 3/2010 | Annerfeldt et al. | |
| 7,686,580 | B2 * | 3/2010 | Cunha | B22C 9/103 415/115 |
| 7,690,894 | B1 | 4/2010 | Liang | |
| 7,901,182 | B2 | 3/2011 | Liang | |
| 7,963,745 | B1 | 6/2011 | Liang | |
| 7,967,566 | B2 * | 6/2011 | Liang | F01D 5/187 416/97 R |
| 2005/0226726 | A1 * | 10/2005 | Lee | F01D 5/187 416/97 R |
| 2006/0222495 | A1 * | 10/2006 | Liang | F01D 5/186 416/97 R |
| 2007/0056709 | A1 * | 3/2007 | Schmidt | B22C 9/04 164/132 |
| 2008/0164001 | A1 * | 7/2008 | Morris | B22C 9/04 164/369 |
| 2010/0129195 | A1 * | 5/2010 | Surace | B22C 7/02 415/115 |
| 2011/0094698 | A1 | 4/2011 | Grunstra | |

* cited by examiner

METHOD OF MANUFACTURING A COOLED TURBINE BLADE WITH DENSE COOLING FIN ARRAY

TECHNICAL FIELD

The present disclosure generally pertains to gas turbine engines, and is more particularly directed toward a method of manufacturing a cooled turbine blade.

BACKGROUND

Internally cooled turbine blades may include passages and vanes (air deflectors) within the blade. These hollow blades may be cast. In casting hollow gas turbine engine blades having internal cooling passageways, a fired ceramic core is positioned in a ceramic investment shell mold to form internal cooling passageways in the cast airfoil. The fired ceramic core used in investment casting of hollow airfoils typically has an airfoil-shaped region with a thin cross-section leading edge region and trailing edge region. Between the leading and trailing edge regions, the core may include elongated and other shaped openings so as to form multiple internal walls, pedestals, turbulators, ribs and similar features separating and/or residing in cooling passageways in the cast airfoil.

U.S. Pat. No. 6,720,028 issued to Haaland on Apr. 13, 2004 shows a method of making an impregnated ceramic core especially useful in casting of hollow gas turbine engine blades and vanes (airfoils). In particular, Haaland shows a fired, porous ceramic core for use in investment casting a hollow gas turbine blade where the core has a configuration of internal cooling passages to be formed in the blade casting.

The present disclosure is directed toward overcoming one or more of the problems discovered by the inventors.

SUMMARY OF THE DISCLOSURE

A method of manufacturing a cooled turbine blade for use in a gas turbine engine is disclosed herein. In particular, a method of manufacturing a cooled turbine blade with dense cooling fin array is described. The method includes forming an inner blade pattern, where the inner blade pattern includes an inner spar and a plurality of inner spar cooling fins. The method also includes forming an inner blade core, removing the inner blade pattern from the inner blade core, forming an outer blade pattern, forming a casting shell, removing the outer blade pattern from the casting shell, and casting the cooled turbine blade in the casting shell. The method also includes removing the casting shell from the cast cooled turbine blade, and removing the inner blade core from the cast cooled turbine blade.

DETAILED DESCRIPTION

Systems and methods for manufacturing a cooled turbine blade are disclosed herein. In particular, a cooled turbine blade with a dense cooling fin array may be manufactured using the following description of the cooled turbine blade to be built, the steps of the method of manufacture, or any combination thereof.

Figure 1:
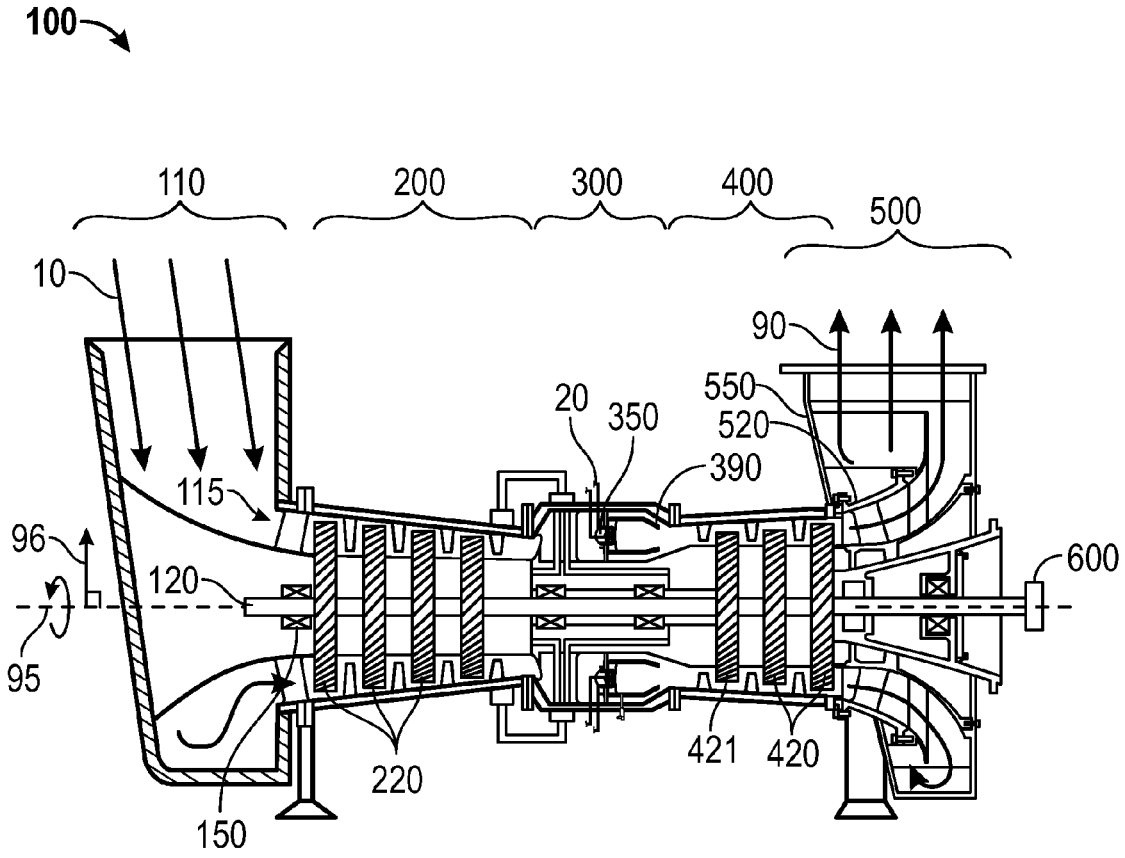
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

Structurally, a gas turbine engine 100 includes an inlet 110, a gas producer or "compressor" 200, a combustor 300, a turbine 400, an exhaust 500, and a power output coupling 600. The compressor 200 includes one or more compressor rotor assemblies 220. The combustor 300 includes one or more injectors 350 and includes one or more combustion chambers 390. The turbine 400 includes one or more turbine rotor assemblies 420. The exhaust 500 includes an exhaust diffuser 520 and an exhaust collector 550.

As illustrated, both compressor rotor assembly 220 and turbine rotor assembly 420 are axial flow rotor assemblies, where each rotor assembly includes a rotor disk that is circumferentially populated with a plurality of airfoils ("rotor blades"). When installed, the rotor blades associated with one rotor disk are axially separated from the rotor blades associated with an adjacent disk by stationary vanes ("stator vanes" or "stators") 250, 450 circumferentially distributed in an annular casing.

Functionally, a gas (typically air 10) enters the inlet 110 as a "working fluid", and is compressed by the compressor 200. In the compressor 200, the working fluid is compressed in an annular flow path 115 by the series of compressor rotor assemblies 220. In particular, the air 10 is compressed in numbered "stages", the stages being associated with each compressor rotor assembly 220. For example, "4th stage air" may be associated with the 4th compressor rotor assembly 220 in the downstream or "aft" direction—going from the inlet 110 towards the exhaust 500). Likewise, each turbine rotor assembly 420 may be associated with a numbered stage. For example, first stage turbine rotor assembly 421 is the forward most of the turbine rotor assemblies 420. However, other numbering/naming conventions may also be used.

Once compressed air 10 leaves the compressor 200, it enters the combustor 300, where it is diffused and fuel 20 is added. Air 10 and fuel 20 are injected into the combustion chamber 390 via injector 350 and ignited. After the combustion reaction, energy is then extracted from the combusted fuel/air mixture via the turbine 400 by each stage of the series of turbine rotor assemblies 420. Exhaust gas 90 may then be diffused in exhaust diffuser 520 and collected, redirected, and exit the system via an exhaust collector 550. Exhaust gas 90 may also be further processed (e.g., to reduce harmful emissions, and/or to recover heat from the exhaust gas 90).

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Figure 2:
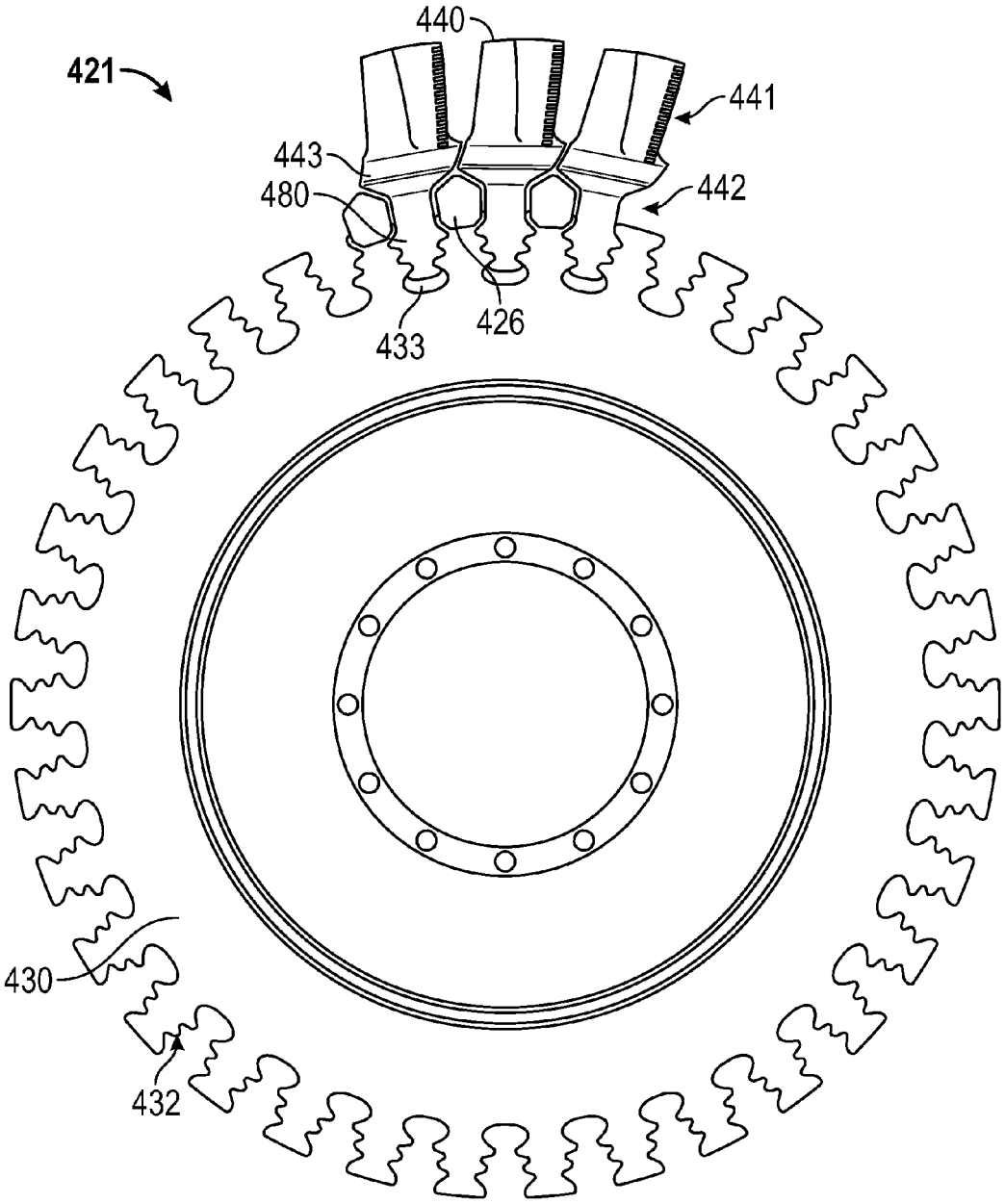
FIG. 2 is an axial view of an exemplary turbine rotor assembly.

FIG. 2 is an axial view of an exemplary turbine rotor assembly. In particular, first stage turbine rotor assembly 421 schematically illustrated in FIG. 1 is shown here in greater detail, but in isolation from the rest of gas turbine engine 100. First stage turbine rotor assembly 421 includes a turbine rotor disk 430 that is circumferentially populated with a plurality of turbine blades configured to receive cooling air ("cooled turbine blades" 440) and a plurality of dampers 426. Here, for illustration purposes, turbine rotor disk 430 is shown depopulated of all but three cooled turbine blades 440 and three dampers 426.

Each cooled turbine blade 440 may include a base 442 including a platform 443 and a blade root 480. For example, the blade root 480 may incorporate "fir tree", "bulb", or "dove tail" roots, to list a few. Correspondingly, the turbine rotor disk 430 may include a plurality of circumferentially distributed slots or "blade attachment grooves" 432 configured to receive and retain each cooled turbine blade 440. In particular, the blade attachment grooves 432 may be configured to mate with the blade root 480, both having a reciprocal shape with each other. In addition the blade attachment grooves 432 may be slideably engaged with the blade attachment grooves 432, for example, in a forward-to-aft direction.

Being proximate the combustor 300 (FIG. 1), the first stage turbine rotor assembly 421 may incorporate active cooling. In particular, compressed cooling air may be internally supplied to each cooled turbine blade 440 as well as predetermined portions of the turbine rotor disk 430. For example, here turbine rotor disk 430 engages the cooled turbine blade 440 such that a cooling air cavity 433 is formed between the blade attachment grooves 432 and the blade root 480. In other embodiments, other stages of the turbine may incorporate active cooling as well.

When a pair of cooled turbine blades 440 is mounted in adjacent blade attachment grooves 432 of turbine rotor disk 430, an under-platform cavity may be formed above the circumferential outer edge of turbine rotor disk 430, between shanks of adjacent blade roots 480, and below their adjacent platforms 443, respectively. As such, each damper 426 may be configured to fit this under-platform cavity. Alternately, where the platforms are flush with circumferential outer edge of turbine rotor disk 430, and/or the under-platform cavity is sufficiently small, the damper 426 may be omitted entirely.

Here, as illustrated, each damper 426 may be configured to constrain received cooling air such that a positive pressure may be created within under-platform cavity to suppress the ingress of hot gases from the turbine. Additionally, damper 426 may be further configured to regulate the flow of cooling air to components downstream of the first stage turbine rotor assembly 421. For example, damper 426 may include one or more aft plate apertures in its aft face. Certain features of the illustration may be simplified and/or differ from a production part for clarity.

Each damper 426 may be configured to be assembled with the turbine rotor disk 430 during assembly of first stage turbine rotor assembly 421, for example, by a press fit. In addition, the damper 426 may form at least a partial seal with the adjacent cooled turbine blades 440. Furthermore, one or more axial faces of damper 426 may be sized to provide sufficient clearance to permit each cooled turbine blade 440 to slide into the blade attachment grooves 432, past the damper 426 without interference after installation of the damper 426.

Figure 3:
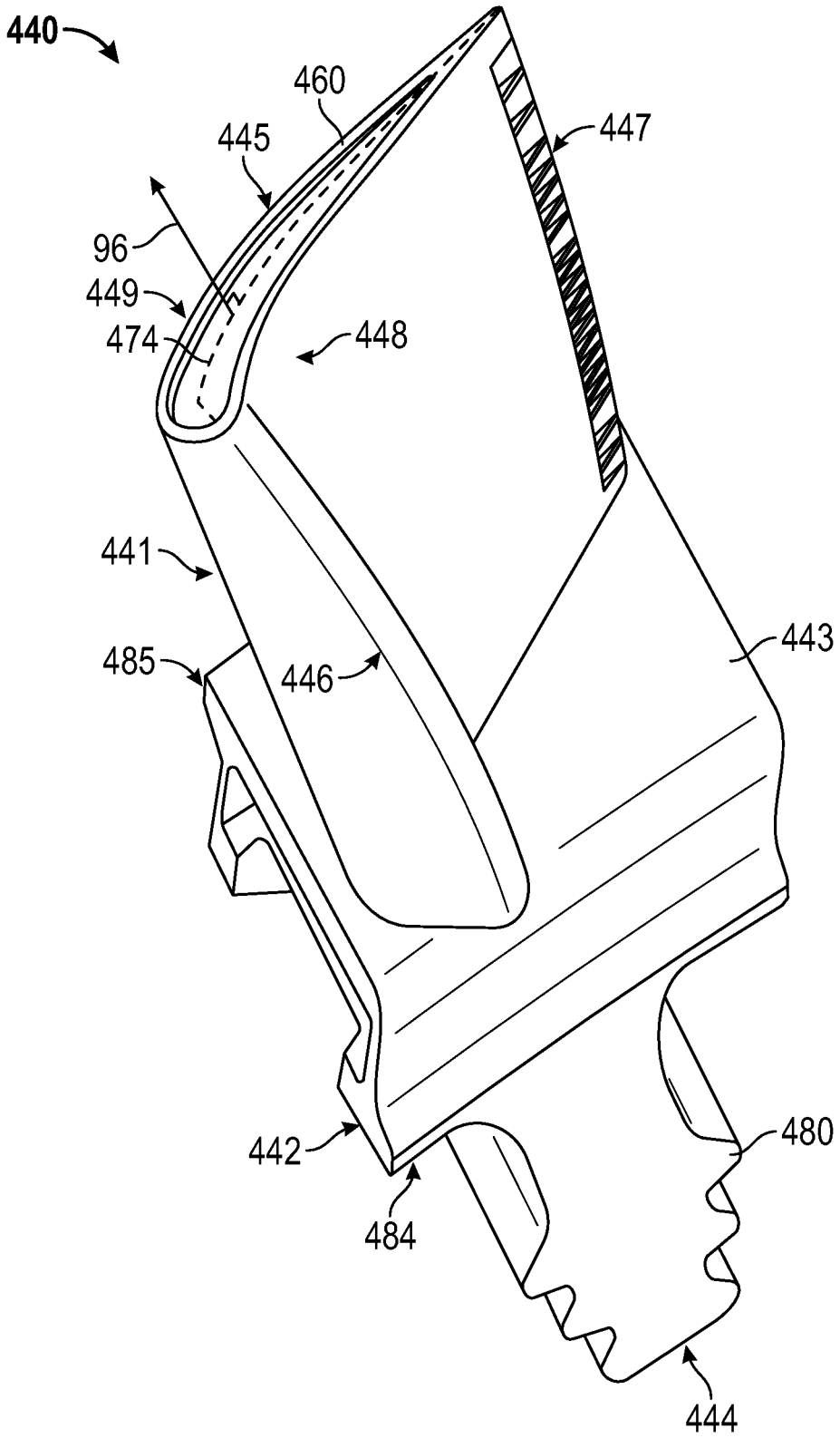
FIG. 3 is an isometric view of one turbine blade of FIG. 2.

FIG. 3 is an isometric view of the turbine blade of FIG. 2. As described above, the cooled turbine blade 440 may include a base 442 having a platform 443 and a blade root 480. Each cooled turbine blade 440 may further include an airfoil 441 extending radially outward from the platform 443. The airfoil 441 may have a complex, geometry that varies radially. For example the cross section of the airfoil 441 may lengthen, thicken, twist, and/or change shape as it radially approaches the platform 443 inward from the tip end 445. The overall shape of airfoil 441 may also vary from application to application.

The cooled turbine blade 440 is generally described herein with reference to its installation and operation. In particular, the cooled turbine blade 440 is described with reference to both a radial 96 of center axis 95 (FIG. 1) and the aerodynamic features of the airfoil 441. The aerodynamic features of the airfoil 441 include a leading edge 446, a trailing edge 447, a pressure side 448, a lift side 449, and its mean camber line 474. The mean camber line 474 is generally defined as the line running along the center of the airfoil from the leading edge 446 to the trailing edge 447. It can be thought of as the average of the pressure side 448 and lift side 449 of the airfoil shape. As discussed above, airfoil 441 also extends radially between the platform 443 and the tip end 445. Accordingly, the mean camber line 474 herein includes the entire camber sheet continuing from the platform 443 to the tip end 445.

Accordingly, when describing the cooled turbine blade 440 as a unit, the inward direction is generally radially inward toward the center axis 95 (FIG. 1), with its associated end called the "root end" 444. Likewise is the outward direction is generally radially outward from the center axis 95 (FIG. 1), with its associated end called the "tip end" 445. When describing the platform 443, the forward edge 484 and the aft edge 485 of the platform 443 are associated the forward and aft axial directions of the center axis 95 (FIG. 1), as described above.

In addition, when describing the airfoil 441, the forward and aft directions are generally measured between its leading edge 446 (forward) and its trailing edge 447 (aft), along the mean camber line 474 (artificially treating the mean camber line 474 as linear). When describing the flow features of the airfoil 441, the inward and outward directions are generally measured in the radial direction relative to the center axis 95 (FIG. 1). However, when describing the thermodynamic features of the airfoil 441 (particularly those associated with the inner spar 462 (FIG. 5)), the inward and outward directions are generally measured in a plane perpendicular to a radial 96 of center axis 95 (FIG. 1) with inward being toward the mean camber line 474 and outward being toward the "skin" 460 of the airfoil 441.

Finally, certain traditional aerodynamics terms may be used from time to time herein for clarity, but without being limiting. For example, while it will be discussed that the airfoil 441 (along with the entire cooled turbine blade 440) may be made as a single metal casting, the outer surface of the airfoil 441 (along with its thickness) is descriptively called herein the "skin" 460 of the airfoil 441.

Figure 4:
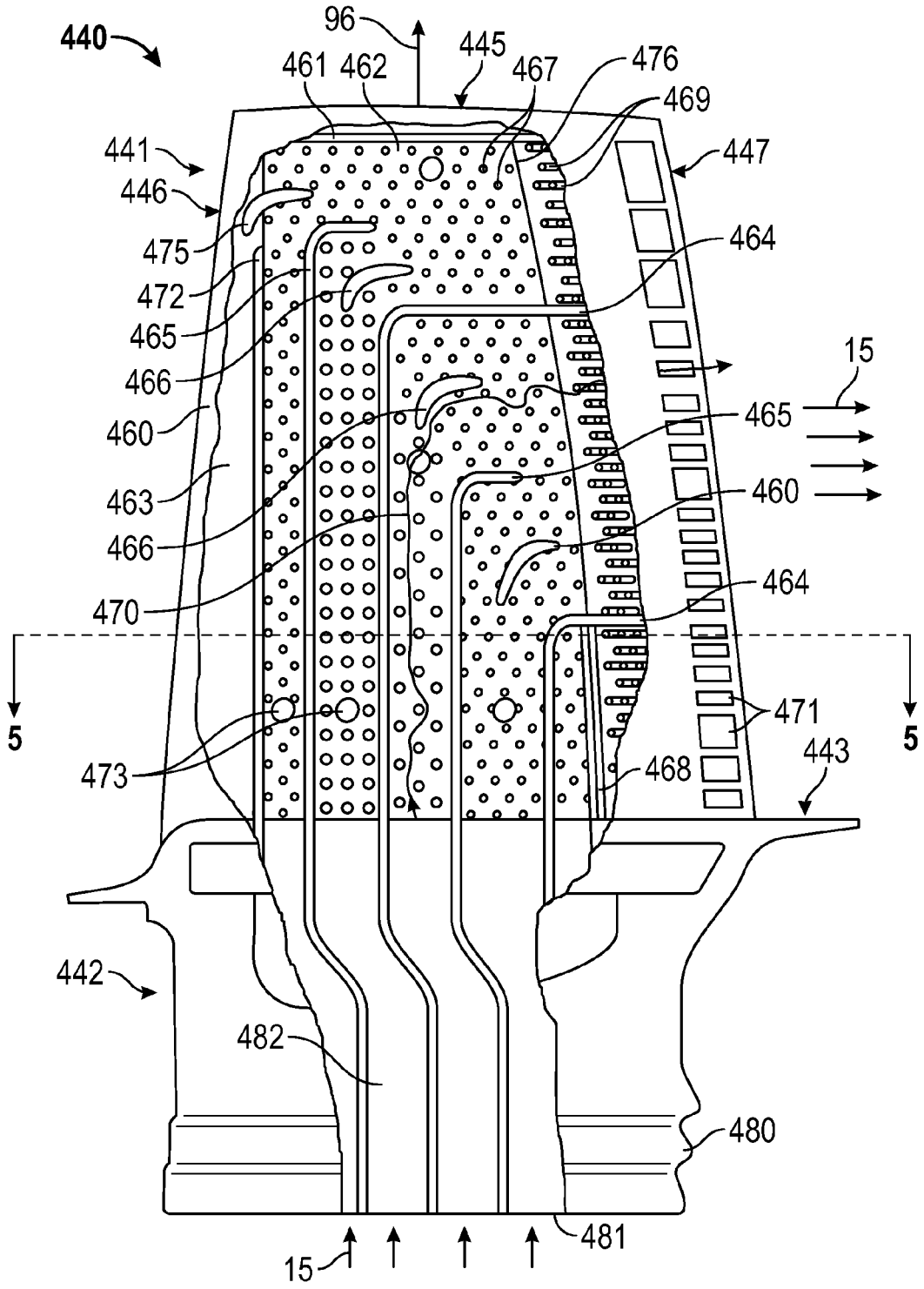
FIG. 4 is a cutaway side view of the turbine blade of FIG. 3.

FIG. 4 is a cutaway side view of the turbine blade of FIG. 3. In particular, the cooled turbine blade 440 of FIG. 3 is shown here with sections of the skin 460 removed from the pressure side 448 of the airfoil 441, exposing its internal structure and cooling paths. For example, the airfoil 441 may include a composite flow path made up of multiple subdivisions and cooling structures. Similarly, a section of the base 442 has been removed to expose portions of a cooling air passageway 482, internal to the base 442.

As described above, the cooled turbine blade 440 may include an airfoil 441 and a base 442. The base 442 may include the platform 443, the blade root 480, and one or more cooling air inlet(s) 481. The airfoil 441 interfaces with the base 442 and may include the skin 460, a tip wall 461, and the cooling air outlet 471.

Compressed secondary air may be routed into one or more cooling air inlet(s) 481 in the base 442 of cooled turbine blade 440 as cooling air 15. The one or more cooling air inlet(s) 481 may be at any convenient location. For example, here the cooling air inlet 481 is located in the blade root 480. Alternately, cooling air 15 may be received in a shank area radially outward from the blade root 480 but radially inward from the platform 443.

Within the base 442, the cooled turbine blade 440 include the cooling air passageway 482 that is configured to route cooling air 15 from the one or more cooling air inlet(s) 481, through the base, and into the airfoil 441. The cooling air passageway 482 may be configured to translate the cooling air 15 in two dimensions (i.e., not merely in the plane of the figure) as it travels radially up (i.e., generally in the direction of a radial 96 of the center axis 95 (FIG. 1)) towards the airfoil 441. Moreover, the cooling air passageway 482 may be structured to receive the cooling air 15 from a generally rectilinear cooling air inlet 481 and smoothly "reshape" it fit the curvature and shape of the airfoil 441. In addition, the cooling air passageway 482 may be subdivided into a plurality of sub-passages. As illustrated, the subdivisions may be evenly spaced, for example.

Within the skin 460 of the airfoil 441, several internal structures are viewable. In particular, airfoil 441 may include a tip wall 461, an inner spar 462, a leading edge chamber 463, one or more section divider(s) 464, one or more rib(s) 465, one or more air deflector(s) 466, and a plurality of inner spar cooling fins 467. In addition, airfoil 441 may include a perforated trailing edge rib 468 and a plurality of trailing edge cooling fins 469. Together with the skin 460, these structures may form a single-bend heat exchange path 470 within the airfoil 441.

The internal structures making up the single-bend heat exchange path 470 may subdivide the single-bend heat exchange path 470 into multiple discrete sub-passageways or "sections". For example, although single-bend heat exchange path 470 is shown by a representative path of cooling air 15, three completely separated sections are illustrated (i.e., separated by section dividers 464) here on the pressure side 448 of cooled turbine blade 440. Furthermore, in the particular embodiment illustrated, a total of six sub-passageways (including leading edge chamber 463) are identifiable.

With regard to the airfoil structures, the tip wall 461 extends across the airfoil 441 and may be configured to redirect cooling air 15 from escaping through the tip end 445. In addition, one embodiment of the tip end 445 is the tip wall 461. Moreover, tip end 445 may be formed as a shared structure, such as a joining of the pressure side 448 and the lift side 449 of the airfoil 441. According to one embodiment, the tip wall 461 may be recessed inward such that it is not flush with the tip of the airfoil 441. According to one embodiment, the tip wall 461 may include one or more perforations (not shown) such that a small quantity of the cooling air 15 may be bled off for film cooling of the tip end 445.

The inner spar 462 may extend from the base 442 radially outward to the tip wall 461, between the pressure side 448 (FIG. 3) and the lift side 449 (FIG. 3) of the skin 460. In addition, the inner spar 462 may extend between the leading edge 446 and the trailing edge 447, parallel with, and generally following, the mean camber line 474 (FIG. 3) of the airfoil 441, and terminating with inner spar trailing edge 476. Accordingly, the inner spar 462 may be configured to bifurcate a portion or all of the airfoil 441 generally along its mean camber line 474 (FIG. 3) and between the pressure side 448 and the lift side 449. Also, the inner spar 462 may be solid (non-perforated) or substantially solid, such that cooling air 15 cannot pass.

According to one embodiment, the inner spar 462 may extend less than the entire length of the mean camber line 474. In particular the inner spar 462 may extend less than ninety percent of the mean camber line 474 and may exclude the leading edge chamber 463 entirely. For example, the inner spar 462 may extend from the leading edge chamber 463, downstream to the plurality of trailing edge cooling fins 469. In addition, the inner spar 462 may have a length within the range of seventy to eighty percent, or approximately three quarters the length of, and along, the mean camber line 474.

According to one embodiment, the inner spar 462 may have a thickness approximately that of other internal structures. In particular, the inner spar 462 may have a wall thickness plus or minus 20% that of the one or more section dividers 464, one or more ribs 465. In addition, the inner spar 462 may be kept with 1.2 times the wall thickness of the skin 460.

According to one embodiment, the inner spar 462 may include one or more inner spar pass-through hole(s) 473. In particular, the inner spar 462 may include perforations such that pressure is equalized between the pressure side 448 (FIG. 5) and the lift side 449 (FIG. 5) of the inner spar 462. For example, an inner spar pass-through hole 473 may be made in each discrete sub-passageway or "section" of the single-bend heat exchange path 470. In addition, depending on the pressure profile of the particular cooled turbine blade 440, a single section may include more than one inner spar pass-through hole(s) 473. Furthermore, the inner spar pass-through hole(s) 473 may be located throughout the inner spar 462. For example, and as illustrated, the inner spar 462 may include inner spar pass-through hole(s) 473 near the platform 443, near the tip wall 461, and/or near the single bend.

Within the airfoil 441, each section divider 464 may extend from the base 442 to the trailing edge 447, generally including a ninety degree turn and including a smooth transition. In addition, each section divider 464 may extend outward from the inner spar 462 to the skin 460 on each of the pressure side 448 (FIG. 3) or the lift side 449 (FIG. 3). Accordingly, cooling air 15 may be constrained within a sub-passageway or "section" of the single-bend heat exchange path 470 defined by the inner spar 462, either of the pressure side 448 (FIG. 3) or the lift side 449 (FIG. 3) of the skin 460, a section divider 464, and one of: an adjacent section divider 464, the tip wall 461, and the base 442.

According to one embodiment, each section divider 464 on one side of inner spar 462 may run parallel with each other. According to another embodiment, a section divider 464 on the pressure side 448 (FIG. 3) of the inner spar 462 may mirror another section divider 464 on the lift side 449 (FIG. 3) of the inner spar 462. Furthermore two "mirrored" section dividers 464 may merge into a single section divider 464 downstream of the inner spar 462 such that the "merged" section divider 464 extends from the pressure side 448 (FIG. 3) of the skin 460 directly to the lift side 449 (FIG. 3) of the skin 460.

Within the airfoil 441, each rib 465 may extend radially from the base 442 toward the tip end 445, terminating prior to reaching the tip wall 461. In addition, each rib 465 may extend outward from the inner spar 462 to the skin 460 on either of the pressure side 448 (FIG. 3) or the lift side 449 (FIG. 3) (i.e., in and out of plane). According to one embodiment, a rib 465 may also include a single bend at its distal end, relative to the base 442. The single bend may be approximately ninety degrees and include a smooth transition. In addition, the rib 465 may run parallel with an adjacent structure (e.g., section divider 464). Furthermore, and as above, a rib 465 on the pressure side 448 (FIG. 3) of the inner spar 462 may mirror another rib 465 on the lift side 449 (FIG. 3) of the inner spar 462.

According to one embodiment, the airfoil 441 may include a leading edge rib 472. The leading edge rib 472 may extend radially from the base 442 toward the tip end 445, terminating prior to reaching the tip wall 461. In addition, the leading edge rib 472 may extend directly from the pressure side 448 (FIG. 3) of the skin 460 to the lift side 449 (FIG. 3) of the skin 460. In doing so, the leading edge rib 472 may form the leading edge chamber 463 in conjunction with the skin 460 at the leading edge 446 of the airfoil 441. Accordingly, the leading edge chamber 463 may form part of the single-bend heat exchange path 470.

Within the airfoil 441, each air deflector 466 may extend outward from the inner spar 462 to the skin 460 on either of the pressure side 448 (FIG. 3) or the lift side 449 (FIG. 3). Each air deflector 466 may include a single bend, which is configured to redirect cooling air 15 approximately ninety degrees. Accordingly, the single bend may be approximately ninety degrees and include a smooth transition. Generally, the single bend of the air deflector 466 may start from a radial/vertical direction and smoothly transition to a horizontal direction aimed toward the trailing edge 447. In addition, the single bend of the air deflector 466 may run parallel with the single bend of an adjacent section divider 464 or rib 465. Furthermore, and as above, an air deflector 466 on the pressure side 448 (FIG. 3) of the inner spar 462 may mirror another air deflector 466 on the lift side 449 (FIG. 3) of the inner spar 462.

According to one embodiment, the airfoil 441 may include a leading edge air deflector 475. As above, the leading edge air deflector 475 may include a single bend, which is configured to redirect cooling air 15 approximately ninety degrees. Accordingly, the single bend may be approximately ninety degrees and include a smooth transition. The leading edge air deflector 475 may be located so as to redirect cooling air 15 leaving the leading edge chamber 463. In particular, the leading edge air deflector 475 may be radially located between the leading edge rib 472 and the tip wall 461. Additionally, the leading edge air deflector 475 may physically interact with the inner spar 462. In particular, the leading edge air deflector 475 may extend from the pressure side 448 (FIG. 3) of the skin 460 to the lift side 449 (FIG. 3) of the skin 460, wherein at least a portion of the leading edge air deflector 475 is intersected by the inner spar 462 between the pressure side 448 (FIG. 3) of the skin 460 and the lift side 449 (FIG. 3) of the skin 460.

Within the airfoil 441, the plurality of inner spar cooling fins 467 may extend outward from the inner spar 462 to the skin 460 on either of the pressure side 448 (FIG. 3) or the lift side 449 (FIG. 3). In contrast, the plurality of trailing edge cooling fins 469 may extend from the pressure side 448 (FIG. 3) of the skin 460 directly to the lift side 449 (FIG. 3) of the skin 460. Accordingly, the plurality of inner spar cooling fins 467 are located forward of the plurality of trailing edge cooling fins 469, as measured along the mean camber line 474 (FIG. 3) of the airfoil 441.

Both the inner spar cooling fins 467 and the trailing edge cooling fins 469 may be disbursed copiously throughout the single-bend heat exchange path 470. In particular, the inner spar cooling fins 467 and the trailing edge cooling fins 469 may be disbursed throughout the airfoil 441 so as to thermally interact with the cooling air 15 for increased cooling. In addition, the distribution may be in the radial direction and in the direction along the mean camber line 474 (FIG. 3). The distribution may be regular, irregular, staggered, and/or localized.

According to one embodiment, the inner spar cooling fins 467 may be long and thin. In particular, inner spar cooling fins 467, traversing less than half the thickness of the airfoil 441 (i.e., between its inner and outer camber lines), may use a "pin" fin. The pin fin may have a cylindrical shape and round profile. Moreover, pin fins having a height-to-diameter ratio of 2-7 may be used. For example, the inner spar cooling fins 467 may be pin fins having a diameter of 0.017-0.040 inches, and a length off the inner spar 462 of 0.034-0.240 inches.

Additionally, according to one embodiment, the inner spar cooling fins 467 may also be densely packed. In particular, inner spar cooling fins 467 may be within two diameters of each other at their interface with the inner spar 462. Thus, a greater number of inner spar cooling fins 467 may be used for increased cooling. For example, across the inner spar 462, the fin density may be in the range of 80 to 300 fins per square inch per side of the inner spar 462.

Within the airfoil 441, the trailing edge rib 468 may extend radially from the base 442 toward the tip end 445. In particular, the trailing edge rib 468 may radially extend between the base 442 and the section divider 464 that defines the subdivision of the single-bend heat exchange path that exhausts nearest the platform 443. In addition, the trailing edge rib 468 may be located along the inner spar trailing edge 476 and between the inner spar cooling fins 467 and the trailing edge cooling fins 469.

Unlike a section divider 464 or a rib 465, the trailing edge rib 468 may be perforated to include one or more openings. This will allow cooling air 15 to pass through the trailing edge rib 468 toward the cooling air outlet 471 in the trailing edge 447, and thus complete the single-bend heat exchange path 470.

Taken as a whole the cooling air passageway 482 and the single-bend heat exchange path 470 may be coordinated. In particular and returning to the base 442 of the cooled turbine blade 440, the cooling air passageway 482 may be sub-divided into a plurality of flow paths. As illustrated, the subdivided cooling air passageway 482 may be coordinated with the one or more section divider(s) 464 and the one or more rib(s) 465 above, in the airfoil 441. Accordingly, each subdivision within the base 442 may be aligned with and include a cross sectional shape (not shown) corresponding to the areas bounded by the skin 460 and each section divider 464 and rib 465. In addition, the cooling air passageway 482 may maintain the same overall cross sectional area (i.e., constant flow rate and pressure) in each subdivision, as between the cooling air inlet 481 and the airfoil 441. Alternately, the cooling air passageway 482 may vary the cross sectional area of individual subdivisions where differing performance parameters are desired for each section, in a particular application.

According to one embodiment, the cooling air passageway 482 and the single-bend heat exchange path 470 may each include asymmetric divisions for reflecting localized thermodynamic flow performance requirements. In particular, as illustrated and discussed above, the cooled turbine blade 440 may have two or more sections divided by the one or more section divider(s) 464. Accordingly, there will be a section on each side of the section divider 464. As with the cooling air passageway 482, each section may maintain the same overall cross sectional area. Alternately, each section divider 464 may be located such that each section varies where different performance parameters are desired for each section, in a particular application. For example, by moving the horizontal arm of section divider 464 radially outward, a larger section is created on its inward side, and vice versa.

Similarly, according one embodiment, the individual inner spar cooling fins 467 and the trailing edge cooling fins 469 may also include localized thermodynamic structural variations. In particular, the inner spar cooling fins 467 and/or the trailing edge cooling fins 469 may have different cross sections/surface area and/or fin spacing at different locations of the inner spar 462. For example, the cooled turbine blade 440 may have localized "hot spots" that favor a greater thermal conductivity, or low internal flow areas that favor reduced airflow resistance. In which case, the individual cooling fins may be modified in shape, size, positioning, spacing, and grouping.

According to one embodiment, one or more of the inner spar cooling fins 467 and the trailing edge cooling fins 469 may be pin fins or pedestals. The pin fins or pedestals may include many different cross-sectional areas, such as: circular, oval, racetrack, square, rectangular, diamond cross-sections, just to mention only a few. As discussed above, the pin fins or pedestals may be arranged as a staggered array, a linear array, or an irregular array.

Figure 5:
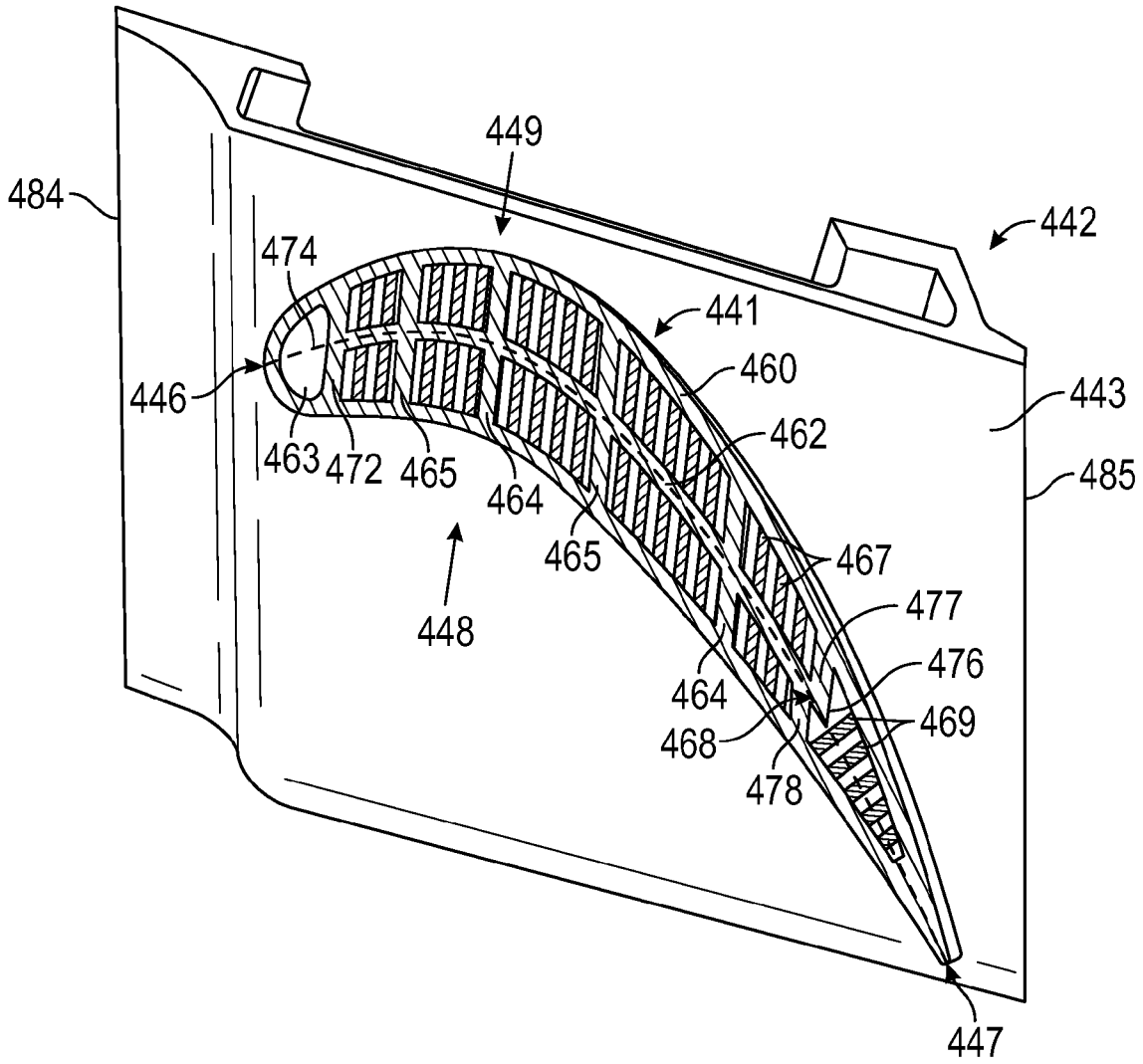
FIG. 5 is a sectional top view of the turbine blade of FIG. 4, as taken along plane indicated by broken line 5-5 of FIG. 4.

FIG. 5 is a sectional top view of the turbine blade of FIG. 4, as taken along plane indicated by broken line 5-5 of FIG. 4. From this view, inner spar 462 and the relationship with the above features and structures within the airfoil 441 are shown. For clarity, only the nearest row of internal structures within the airfoil 441 is shown. In addition, some of the cutaway internal structures are illustrated with alternating hatching for convenience and clarity; however, as discussed herein, in different embodiments they may be made from the same or different materials.

As illustrated, airfoil 441 may have a varying profile in the radial direction. In particular, airfoil 441 may have a greater thickness near the platform 443 of base 442 than near the tip end 445 (FIG. 3), as can be seen viewing both FIG. 3 (showing the airfoil 441 at the tip end 445) and FIG. 5 (showing the airfoil 441 closer to the base 442). The illustrated shape of the airfoil 441 is merely representative, and may vary from application to application. Moreover, airfoil 441 may retain its aerodynamic features (i.e., leading edge 446, trailing edge 447, pressure side 448, lift side 449, and mean camber line 474) independent of its particular shape. Also, the illustrated thickness of the skin 460 and the structures residing within are also representative and not limiting.

As illustrated, inner spar 462 may be located in between the pressure side 448 of the skin 460 and the lift side 449 the skin 460. In particular, the inner spar 462 may substantially coincide with the mean camber line 474 of the airfoil 441. Accordingly, inner spar 462 may bifurcate the single-bend heat exchange path 470 into a cavity associated with the pressure side 448 of the airfoil 441 and a cavity associated with the lift side 449 of the airfoil 441. Moreover, each section divider 464 and each rib 465 may further sub-divide the single-bend heat exchange path 470. In particular and as discussed above, each section divider 464 and each rib 465 may extend outward from the inner spar 462 to the skin 460 on both the pressure side 448 and the lift side 449, limiting cross flow within the single-bend heat exchange path 470 and subdividing the cavity on the pressure side 448 on the lift side 449 into a series of generally parallel cavities/flow passages.

According to one embodiment, inner spar 462 may extend between the leading edge chamber 463, at the leading edge rib 472, and the trailing edge rib 468. As above and as illustrated, leading edge rib 472 and the trailing edge rib 468 may each extend from the pressure side 448 of the skin 460 directly to the lift side 449 of the skin 460. Accordingly, the forward and aft ends of the inner spar 462 may be bound along the mean camber line 474 by the leading edge rib 472 and the trailing edge rib 468, respectively. Notably, the origination of the inner spar 462 at the leading edge rib 472 provides for an increased cross section of the leading edge chamber 463. Notwithstanding, according to one embodiment, the inner spar 462 may extend at least seventy-five percent the length of the mean camber line 474.

As illustrated and discussed above, inner spar 462 may support the extension of the one or more section dividers 464, the one or more ribs 465, the one or more air deflectors 466, and the plurality of inner spar cooling fins 467. In particular, each structure/feature may extend from the inner spar 462 to the pressure side 448 or the lift side 449 of the airfoil 441. According to another embodiment, each structure/feature may run parallel to each other. Likewise, each structure/feature may be oriented perpendicular to the forward edge 484 (of aft edge 485) of the platform 443, which may also be viewed as perpendicular to the center axis 95 (FIG. 1).

For convenience or clarity, and as the entire cooled turbine blade 440 may be formed as a single casting, each structure/feature having a mirror structure/feature opposite the inner spar 462 may be equally treated or referred to as a single member or as two separate members. For example, section dividers 464 on both sides of the inner spar 462 may equally be described as two separated members (i.e., as a first section divider 464 extending from the inner spar 462 to the lift side 449 of the skin 460 and a second section divider 464 extending from the inner spar 462 to the pressure side 449 of the skin 460) or as a single member that passes through or includes the corresponding section of the inner spar 462 (i.e., as a section divider 464 extending between the skin 460 on the lift side 449 and to the skin 460 on the pressure side 448).

According to one embodiment and as illustrated each structure/feature may include a "mirror image" on the opposite side of the inner spar 462. Notably, as the section cut is taken radially inward of the single bend of the section dividers 464, only a portion is illustrated. As discussed above each section divider 464 may extend to the trailing edge 447, and two "mirrored" section dividers 464 may merge into a single section divider 464 downstream of the inner spar 462 such that the "merged" section divider 464 extends from the pressure side 448 of the skin 460 directly to the lift side 449 of the skin 460.

Both the inner spar cooling fins 467 and the trailing edge cooling fins 469 may be oriented for thermal performance, structural performance, and/or manufacturability. For example, the plurality of inner spar cooling fins 467 may be oriented substantially parallel to each other and perpendicular to the center axis 95. In addition, plurality of inner spar cooling fins 467 may populate at least ten percent of the volume of the single-bend heat exchange path 470. Also, the plurality of first inner spar cooling fins 467 may have a length at least twenty-five percent longer than the thickness of the inner spar 462, as measured between the inner spar 462 and the pressure side 448 or the lift side 449 of the airfoil 441.

With regard to the structures/features toward the trailing edge 447 of the airfoil 441, having a narrower thickness, the structures/features may extend directly from the pressure side 448 to the lift side 449 of the skin 460. In particular, both the trailing edge rib 468 and the plurality of trailing edge cooling fins 469 may extend skin-to-skin. Like the inner spar cooling fins 467, the plurality of trailing edge cooling fins 469 may be oriented substantially parallel to each other. However, trailing edge cooling fins 469 may also be oriented so as to reduce the distance of the span between the pressure side 448 and the lift side 449 of the skin 460. For example, the plurality of trailing edge cooling fins 469 may be oriented substantially perpendicular to the mean camber line 474. Alternately, the plurality of trailing edge cooling fins 469 may be oriented substantially perpendicular to the skin 460 of the airfoil 441 as averaged between the pressure side 448 and the lift side 449.

According to one embodiment the trailing edge rib 468 may be segmented and offset on each side of the inner spar 462. In particular, rather than the trailing edge rib 468 being a single perforated rib extending skin-to-skin at the aft end of inner spar 462, it may be offset on each side of inner spar 462. Being segmented and offset, the trailing edge rib 468 may have a "zigzag" shape in cross section, as shown.

For convenience or clarity, and as the entire cooled turbine blade 440 may be formed as a single casting, the segmented and offset trailing edge rib 468 may be equally treated as a single member or as two separate members. For example, trailing edge rib 468 may be described separately as a first trailing edge rib 477 extending from the inner spar 462 to the lift side 449 of the skin 460 and a second trailing edge rib 478 extending from the inner spar 462 to the pressure side 449 of the skin 460. Furthermore, the first trailing edge rib 477 may be described as interfacing with the inner spar 462 at its aft end, relative to the mean camber line 474. Meanwhile, second trailing edge rib 478 may be offset, interfacing with the inner spar 462 slightly forward of its aft end, relative to the mean camber line 474.

The amount of offset may vary based on the relative angularity and proximity of the internal structures. In addition, the positions and offset may be determined based on the dimensions of the internal structures and/or their relative proximity at different points. In particular, the trailing edge cooling fins 469 may be at a first angle, and the trailing edge rib 468 (made up of the first trailing edge rib 477, the second trailing edge rib 478, and the intervening portion of inner spar 462) may be at a second angle. The "leg" of the trailing edge rib 468 on the pressure side (second trailing edge rib 478) may be offset so as to avoid interference between the trailing edge rib 468 and the trailing edge cooling fins 469 given their relative angularity.

To illustrate the relative angularity, certain conventions should be used. In particular, the trailing edge cooling fins 469, being parallel to each other, may be represented by the first angle. Likewise, the first trailing edge rib 477 and the second trailing edge rib 478, being parallel to each other, may be represented by the second angle. Being a relative measurement, the first and second angles are measured in the same plane, and the starting (i.e., zero degree) axis is common to both. Accordingly, as illustrated here, the first angle and the second angle would be measured in the plane of the figure, i.e., in a plane normal to a radial 96 (FIG. 4) of the center axis 95 (FIG. 1).

The relative angularity and proximity determine the position of the first trailing edge rib 477. As shown, the trailing edge of the first trailing edge rib 477 coincides with the inner spar trailing edge 476. Given the relative angularity between the first trailing edge rib 477 and the trailing edge cooling fins 469, the interference location would be at the intersection of the first trailing edge rib 477 and the inner spar 462.

For example, using the dimensions of the internal structures and with the trailing edge cooling fins 469 configured as pin fins having a round cross section, the positioning and offset may focus on maintaining a minimum gap. In particular, the first trailing edge rib 477 may be kept from the nearest trailing edge cooling fin 469 by a distance of at least at least one diameter of the trailing edge cooling fin 469. The distance may be measured by consistently using any convenient convention such as measuring from the structure midpoint, leading side, trailing side, etc. Accordingly, with the offset discussed below, either the inner spar 462 may be lengthened (along with the position of the first trailing edge rib 477) or additional trailing edge cooling fins 469 may be added to close the gap such that the nearest trailing edge cooling fin 469 does not interfere with the inner spar 462.

The second trailing edge rib 478 is then offset such that it interfaces with the skin 460 on the pressure side 448 of airfoil 441 without interfering with the nearest trailing edge cooling fin 469 at the skin 460 on the pressure side 448 of airfoil 441. As above, interference may go beyond "contact" and include a "gap" of at least one diameter (or similar cross sectional dimension) of the trailing edge cooling fin 469 between the second trailing edge rib 478 and the nearest trailing edge cooling fin 469.

In addition, there may be a minimum offset between the first trailing edge rib 477 and the second trailing edge rib 478. In particular, below a certain offset the benefits become outweighed. For example, according to one embodiment, the first trailing edge rib 477 and the second trailing edge rib 478 may have the same thickness and the offset may be at least that amount. Thus, and according to one embodiment, the first trailing edge rib 477 and the second trailing edge rib 478 may be offset by at least their thickness, as measured along the mean camber line 474.

Also for example, using the relative proximity of the internal structures, the positioning and offset may focus on minimizing free/unpopulated space. In particular, the first trailing edge rib 477 will land on the skin 460 at a first shortest distance (on the lift side 449) from where the nearest trailing edge cooling fin 469 lands on the skin 460 on the lift side 449. The second trailing edge rib 478 may then be offset, relative to the mean camber line 474, such that second trailing edge rib 478 lands on the skin 460 (on the pressure side 448) at a second shortest distance from where the nearest trailing edge cooling fin 469 lands on the skin 460 on the pressure side 448. Given the relative angularity, the offset may be such that the first shortest distance is greater than the second shortest distance.

Moreover, the amount of offset may be further limited such that the second shortest distance (i.e., between the trailing edge cooling fin 469 and the second trailing edge rib 478 on the pressure side 448) is minimized. For example, a third shortest distance may be measured between the second trailing edge rib 478 and the nearest trailing edge cooling fin 469 (e.g., at the inner spar 462/along the mean camber line 474). Then, the offset may be minimized by making the second shortest distance approximately the same (e.g., +/−10%) as a third shortest distance. In other words, the trailing edge rib 468 (and thus the first trailing edge rib 477 and the second trailing edge rib 478) may have a minimized offset that prevents interferences while providing greater surface area on the inner spar 462 for additional inner spar cooling fins 467 and/or additional trailing edge cooling fins 469.

Figure 6:
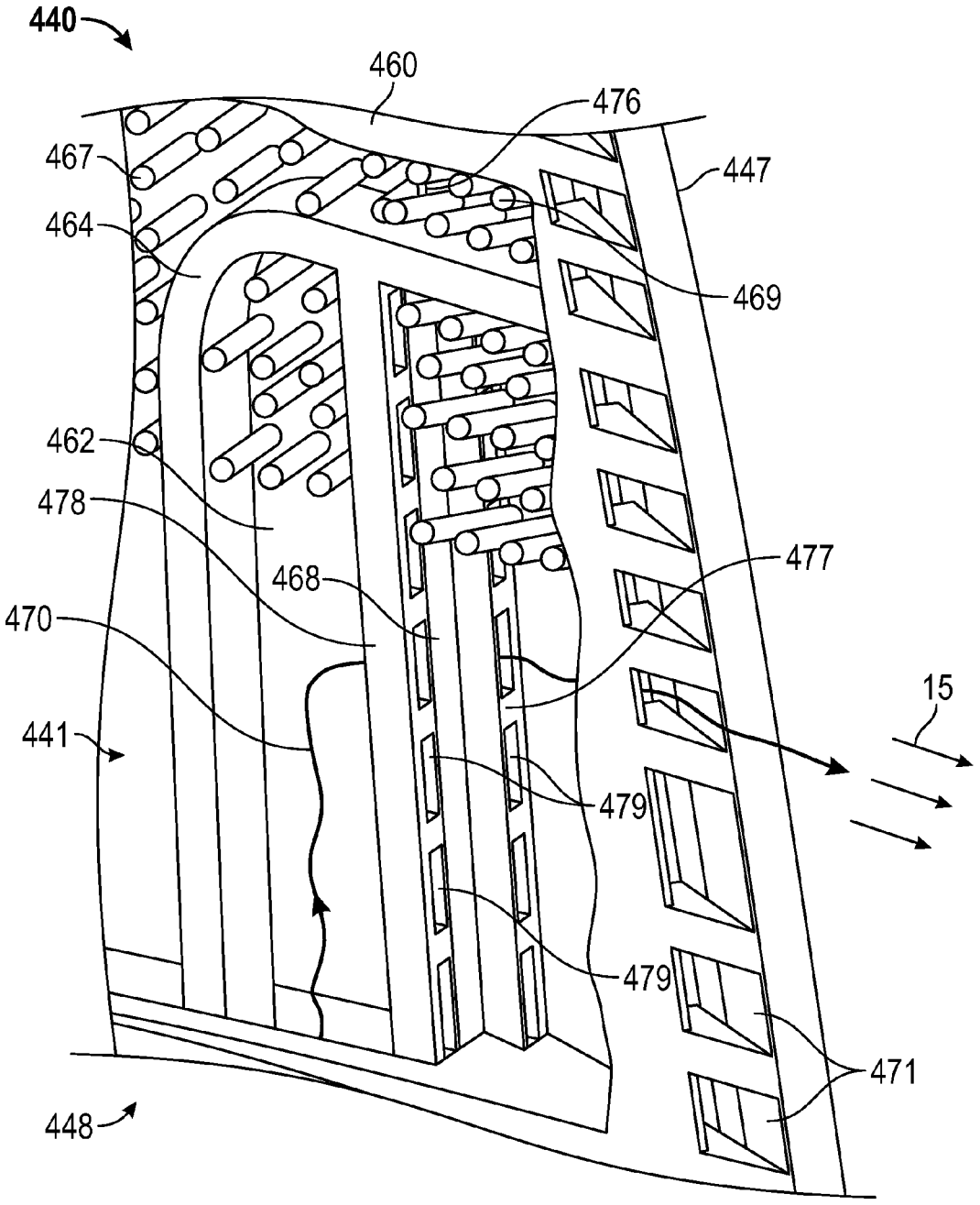
FIG. 6 is an isometric cutaway view of a portion of the turbine blade of FIG. 3.

FIG. 6 is an isometric cutaway view of a portion of the turbine blade of FIG. 3. In particular, a portion of the cooled turbine blade 440 near the trailing edge 447 and the platform 443 is shown. Additionally, for clarity and to better view the trailing edge rib 468, certain features and structures are omitted. These include sections of the skin 460 on the pressure side 448 of the airfoil 441 and sections of the platform 443, as well as the inner spar cooling fins 467 and the trailing edge cooling fins 469, which are all shown in FIG. 5.

As discussed above, the trailing edge rib 468 may be segmented and offset across the inner spar 462 at the inner spar trailing edge 476. In particular, the trailing edge rib 468 may be segmented and offset to include the first trailing edge rib 477 extending from the skin 460 (on the lift side 449) to the inner spar 462 (at its aft end, as measured along mean camber line 474—FIG. 5), the second trailing edge rib 478 extending from the skin 460 (on the pressure side 448) to the inner spar 462 (offset from its aft end, as measured along mean camber line 474—FIG. 5), and any portion of the inner spar 462 there between.

As illustrated, the first trailing edge rib 477 and the second trailing edge rib 478 may run parallel with each other on opposing sides of inner spar 462, as well as with other structures/features. In particular, the first trailing edge rib 477 and the second trailing edge rib 478 may extend from the inner spar 462 to the skin 460 in a parallel manner to each other, and parallel with, for example, section divider 464.

Also as discussed above, structures/features toward the trailing edge 447 may have different orientations and represented by a first angle and a second angle. In particular, the trailing edge cooling fins 469 (FIG. 5) may be angled so as to provide for direct extension between opposing sides of the skin 460 without interacting with the inner spar 462. Thus, the plurality of trailing edge cooling fins 469, being parallel, may be represented by a single "first" angle. Here, the first angle is substantially perpendicular to the mean camber line 474 (FIG. 5).

Likewise, the first trailing edge rib 477 and the second trailing edge rib 478, sharing the same orientation with the other structures/features interfacing with the inner spar 462, may be represented by a "second" angle. Here, the second angle substantially aligns with the forward edge 484 or aft edge 485 of platform 443 (FIG. 5).

As illustrated, the first angle and the second angle may conveniently share a coordinate system in a plane tangential to the center axis 95 (FIG. 1), which would coincide with a top view of the cooled turbine blade 440 looking down a radial 96 (FIG. 1). As discussed above, this perspective shows the "zigzag" shape of the trailing edge rib 468.

Furthermore, while the first and second angles may vary from each other depending on a variety of design considerations, the disclosed segmentation and offset ("zigzag" shape) may be selected so as to provide for extending the length of the inner spar 462. In particular, the inner spar 462 may extend up to the nearest trailing edge cooling fin 469. Accordingly, given the non-parallel first and second angle, the second trailing edge rib 478 may be offset upstream, sufficiently to provide substantially the same clearance with the nearest trailing edge cooling fin 469 at the interface with the skin 460 at the pressure side 448 as with the inner spar 462. The clearance with the inner spar being measured generally in the direction of the mean camber line 474 (FIG. 5).

Also as discussed above, each segment may be perforated. In particular, the first trailing edge rib 477 and the second trailing edge rib 478 may include one or more openings 479. The openings 479 are configured to provide a passageway for cooling air 15 to escape to the cooling air outlet 471 from a section bound by the inner spar 462, the skin 460, and at least one section divider 464.

Accordingly, the trailing edge rib 468 may be configured as a manifold with the upstream section functioning somewhat as a plenum. As such, the upstream section may provide crossover of the upstream flow within the upstream section and greater control of the flow distribution/profile that passes the trailing edge rib 468. For example, the openings 479 may be of a uniform cross section. Alternately, the openings 479 may have a non-uniform cross section and be configured to output a non-uniform flow for particular cooling needs. According to one embodiment, the trailing edge rib 468 may block at least 25% of the section(s) of the single-bend heat exchange path 470 in which it is located so as to give greater control of the flow distribution/profile.

Moreover, the trailing edge rib 468 may be configured to meter the flow of cooling air 15 in one or more sections of the single-bend heat exchange path 470. In particular, the openings 479 may be sized to control the flow rate of the cooling air 15 entering into the trailing edge cavity for a set of input conditions. For example, in an engine having a set secondary air supply pressure, the aggregate cross sectional area of the openings 479 may be selected to control or otherwise limit the overall flow of cooling air 15. According to one embodiment, trailing edge rib 468 may be configured to tune a cooled turbine blade 440 to reproduce that output of another or a previous design. In this way, the cooled turbine blade 440 described above may be used as part of a retrofit of blades having the other design.

In addition, the openings 479 may be of any convenient geometry. In particular, the openings 479 may be shaped to address issues of manufacturability, thermal performance/control, structural performance, and/or flow efficiency. For example, as illustrated, the openings 479 may be of a uniform rectangular cross section along the entire length of the trailing edge rib 468. Alternately, each individual opening 479 may vary in cross sectional area for even finer flow control of cooling air 15, downstream of the trailing edge rib 468.

According to one embodiment, trailing edge rib 468 may target one or more sections of the single-bend heat exchange path 470. In particular, the trailing edge rib 468 may extend along the inner spar trailing edge 476 of a specific section of the single-bend heat exchange path 470, but not others. For example and as illustrated, where there is a need for flow control in the section of the airfoil 441 nearest the platform 443, but less need toward the tip end 445, trailing edge rib 468 may radially extend from the base 442 to the innermost section divider. In this way, cooling air 15 may be metered in the first section (proximate the platform 443), while passing freely aft of inner spar in the remaining sections.

Figure 7:
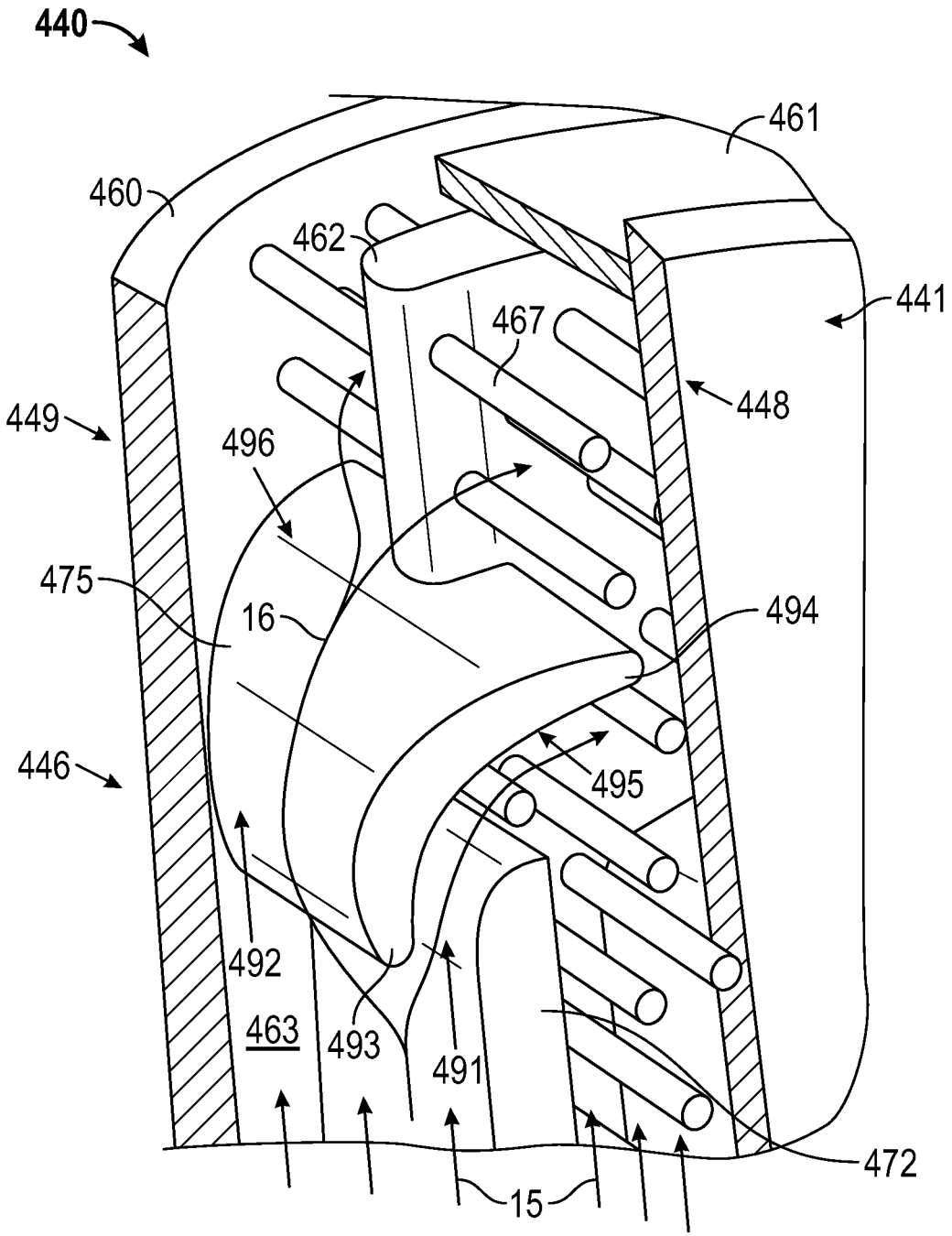
FIG. 7 is an isometric cutaway view of a portion of the turbine blade of FIG. 3.

FIG. 7 is an isometric cutaway view of a portion of the turbine blade of FIG. 3. In particular, a section of the cooled turbine blade 440 near the leading edge 446 and the tip wall 461 is shown with portions of the skin 460 and the tip wall 461 cut away to expose leading edge air deflector 475. The leading edge air deflector 475 is described below with reference to both FIG. 7 and FIG. 4. Likewise, the reference numbers used in FIG. 7 refer to the same items illustrated in FIG. 4.

The leading edge air deflector 475 may be configured to divide cooling air 15 from a single flow traveling through the leading edge chamber 463 to a plurality of cooling flows 16. In particular, the leading edge air deflector 475 may be positioned such that an inner gap 491 is made between the leading edge air deflector 475 and the leading edge rib 472. The leading edge air deflector 475 may be further positioned such that an outer gap 492 is made between the leading edge air deflector 475 and the leading edge 446 of the airfoil 441. In addition, the outer gap 492 continues downstream between the leading edge air deflector 475 and the tip wall 461.

For example, the leading edge air deflector 475 may be positioned to reach into the leading edge chamber 463 radially upstream of the termination of the leading edge rib 472. Accordingly, since the leading edge air deflector 475 interfaces directly with skin 460 on each side, cooling air 15 is initially divided into two passageways, through the inner gap 491 and the outer gap 492. Furthermore, since the leading edge air deflector 475 is intersected by the inner spar 462 between each side, the two passageways are further divided into four passageways by the leading edge air deflector 475 on each side of the inner spar 462.

According to one embodiment, the leading edge air deflector 475 may be sized to affect the profile of cooling air 15 created across and downstream of leading edge air deflector 475. In particular, the leading edge air deflector 475 may have an average aerodynamic thickness proportionate to that of the leading edge rib 472 (e.g., aerodynamic thicknesses being measured between camber lines and/or approximately perpendicular with the internal flows on opposite sides of the member, and at a location where the members are proximate each other). For example, the leading edge air deflector 475 may have an average aerodynamic thickness within twenty percent, within ten percent, or between ten percent and twenty percent of the thickness of the leading edge rib 472.

Alternately, the leading edge air deflector 475 may have a maximum aerodynamic thickness proportionate to or approximately the same to that of the leading edge rib 472. For example, the leading edge air deflector 475 may have a maximum aerodynamic thickness within twenty percent, within ten percent, or between ten percent and twenty percent of the thickness of the leading edge rib 472. Where the thickness of the leading edge rib 472 varies, a maximum thickness, average thickness, or proximate thickness (i.e., near the leading edge air deflector 475) may be used.

Alternately, the leading edge air deflector 475 may have a maximum aerodynamic thickness proportionate to or approximately the same to that of the skin 460 of the airfoil 441. For example, the leading edge air deflector 475 may have a maximum aerodynamic thickness within twenty percent, within ten percent, or between ten percent and twenty percent of the thickness of the skin 460. Where the thickness of the skin 460 varies, its thickness may be measured proximate the leading edge air deflector 475. Where the thickness of the leading edge air deflector 475 varies significantly, an average thickness may alternately be used. According to another embodiment the leading edge air deflector 475 may have a maximum aerodynamic thickness of 1.5 times the thickness of the skin 460 or fall within the range of 1.0 to 2.0 times the thickness of the skin 460. According to another embodiment the leading edge air deflector 475 may have a maximum aerodynamic thickness of 0.040" or between 0.030"-0.050".

According to one embodiment, the leading edge air deflector 475 may also be positioned to affect the profile of cooling air 15 created across and downstream of leading edge air deflector 475. In particular, the leading edge air deflector 475 may be positioned between and relative to the skin 460 of the airfoil 441 and the leading edge rib 472 to affect the flow through the inner gap 491 and the outer gap 492. In addition, the leading edge air deflector 475 may be positioned between and relative to the tip wall 461 and the radially outward end of leading edge rib 472 to further affect the flow through the inner gap 491 and the outer gap 492. Similarly, the leading edge air deflector 475 may be positioned relative to the inner spar 462 to affect the flow on each side of the inner spar 462.

For example, and as shown, the leading edge air deflector 475 may create a balanced profile of cooling air 15. In particular, the leading edge air deflector 475 may be positioned such that the flow rate of cooling air 15 through the inner gap 491 is approximately equal to the flow rate of cooling air 15 through the outer gap 492. Additionally, the leading edge air deflector 475 may be positioned relative to the inner spar 462 such that the portion of cooling air 15 passing though the inner gap 491 is evenly divided on each side of inner spar 462, and the portion of cooling air 15 passing though the outer gap 492 is evenly divided on each side of inner spar 462.

Alternately, the leading edge air deflector 475 may be positioned so as to create a predetermined inner gap 491 and/or outer gap 492, affecting the plurality of cooling flows 16 across and downstream of the leading edge air deflector 475. In particular, the leading edge air deflector 475 may be positioned to give the inner gap 491 and/or outer gap 492 a predetermined maximum gap distance (e.g., as measured normal to the outer surface of the leading edge air deflector 475), a predetermined cross sectional flow area, and/or a predetermined flow rate.

For example, the leading edge air deflector 475 may be positioned such that the maximum gap distance of the inner gap 491 and/or the outer gap 492 is proportionate to or approximately the same as (e.g., within twenty percent, within ten percent, or between ten percent and twenty percent of) the thickness of the leading edge rib 472. Where the thickness of the leading edge rib 472 varies, a maximum thickness, average thickness, or proximate thickness (i.e., near the leading edge air deflector 475) may be used.

Also for example, the leading edge air deflector 475 may be positioned such that the maximum gap distance of the inner gap 491 and/or the outer gap 492 is proportionate to or approximately the same as the maximum aerodynamic thickness of the leading edge air deflector 475. According to one embodiment, this inner gap 491 and/or the outer gap 492 may also be proportionate to or approximately the same as of the thickness of the leading edge rib 472 (i.e., inner gap 491 and/or the outer gap 492, leading edge rib 472, and leading edge air deflector 475 all measure approximately the same).

Alternately, the leading edge air deflector 475 may be positioned such that the cross sectional flow area and/or the flow rate of cooling air 15 through the inner gap 491 is within twenty percent, within ten percent, or between ten percent and twenty percent of the cross sectional flow area and/or the flow rate of cooling air 15 through the outer gap 492. Moreover, according to one embodiment the leading edge air deflector 475 may be positioned such that at least twenty percent more cooling air 15 must pass through the outer gap 492 than through the inner gap 491 to leave the leading edge chamber 463. For example, the leading edge air deflector 475 may be positioned such that approximately sixty percent of the cooling air 15 traveling through the leading edge chamber 463 travels through the outer gap 492, and approximately forty percent travels through the inner gap 491.

In addition to dividing the cooling air 15 from the leading edge chamber into the plurality of cooling flows, the leading edge air deflector 475 may turn and diffuse the cooling air 15. In particular, the leading edge air deflector 475 turns and diffuses the cooling air 15 in conjunction with the skin 460, the leading edge rib 472, and the tip wall 461. Also, the leading edge air deflector 475 may rejoin the "turned" cooling air 15 with the "diffused" cooling air 15 immediately downstream of the leading edge air deflector 475.

The leading edge air deflector 475 includes a leading edge 493, a trailing edge 494, a turning side 495, and a diffusion side 496. The leading edge 493 and the trailing edge 494 of the leading edge air deflector 475 are configured to work in conjunction with the turning side 495 and the diffusion side 496 of the leading edge air deflector 475 to smoothly divide and direct the cooling air 15 into the inner gap 491 and the outer gap 492. In particular, the leading edge 493 and the trailing edge 494 may smoothly join the turning side 495 and the diffusion side 496 to form an airfoil shape having a high rate of camber.

Furthermore, the leading edge air deflector 475 may be shaped and positioned such that cooling air passing though the inner gap 491 is generally turned ninety degrees from a radial direction to an axial direction along the mean camber line 474 (FIG. 3) of inner spar 462. The leading edge air deflector 475 may be further shaped and positioned such that cooling air passing though the outer gap 492 is also generally turned in conjunction with tip wall 461, but additionally diffused. According to one embodiment, the leading edge air deflector 475 may have an angle change between the leading edge 493 and the trailing edge 494 of ninety degrees plus or minus ten degrees. In other words, the leading edge air deflector 475 may be further configured to turn the cooling air 15 between eighty and one hundred degrees from its leading edge 493 to its trailing edge 494.

The turning side 495 of the leading edge air deflector 475 works in conjunction with the leading edge rib 472 to form the inner gap 491 and turn cooling air 15 passing through inner gap 491. In particular, turning side 495 may form a smooth, concave curve beginning at the leading edge 493 and ending at the trailing edge 494. In addition the radially outward end of the leading edge rib 472 may be rounded in the region forming the inner gap 491. For example, the leading edge rib 472 may be rounded such that its curvature is concentric with and matches the curvature of the turning side 495 along a shared radial of both curves and through all or at least a portion of the single bend. The turning side 495 of the leading edge air deflector 475 may straighten out, decreasing in curvature, downstream of the leading edge rib 472.

The diffusion side 496 of the leading edge air deflector 475 works in conjunction with the skin 460 at the leading edge 446 of the airfoil 441 to form the outer gap 492, and with the tip wall 461 to turn the cooling air 15 passing through inner gap 491. In particular, the diffusion side 496 may form a smooth, convex, high camber curve beginning at the leading edge 493 and ending at the trailing edge 494.

As illustrated, the diffusion side 496 of the leading edge air deflector 475 forms an airfoil curve that resists separation from the leading edge air deflector 475 as cooling air 15 traverses the outer gap 492. It is understood that the curvature of the leading edge air deflector 475 may vary according to the operating conditions of the cooled turbine blade 440. Accordingly, while the airfoil curve may generally turn ninety degrees, the camber of the diffusion side 496 may vary from application to application. According to one embodiment, the diffusion side 495 of the leading edge air deflector 475 may straighten out (i.e., decreasing in curvature) downstream of the leading edge rib 472.

With regard to diffusion, the leading edge air deflector 475 may be shaped and positioned to support a predetermined diffusion rate at the tip end 445 of the cooled turbine blade 440. In particular, the outer gap 492 may have a larger flow cross sectional area at the trailing edge 494 than at the leading edge 493 of the leading edge air deflector 475. For example, the outer gap 492 may have a diffusion ratio of 1:5.5, or in the range of 1:4.5 to 1:6.5, taken across the outer gap 492, between the trailing edge 494 and the leading edge 493 of the leading edge air deflector 475. Also for example, the inner gap 491 may have a diffusion ratio of 1:2, or in the range of 1:1.5 to 1:2.5, taken across the inner gap 491, between the trailing edge 494 and the leading edge 493 of the leading edge air deflector 475.

According to one embodiment, the curvature of the diffusion side 496 may be smoothly contoured so as to minimize the pressure drop (head loss) associated with separation losses. In particular, the curvature of the diffusion side 496 may be shaped/selected to maintain laminar flow around the single bend of the flow though the outer gap 492. For example, the curvature of the diffusion side 496 may be selected such that, under the operating conditions of the cooled turbine blade 440, there is two percent or less pressure loss between the leading edge 493 and the trailing edge 494 of the leading edge air deflector 475. According to another embodiment, the curvature of the diffusion side 496 may be shaped so as to provide five percent or less pressure loss between the leading edge 493 and the trailing edge 494 of the leading edge air deflector 475.

Additional criteria may be used to conform the shape of the leading edge air deflector 475. In particular, the leading edge air deflector 475 may be further limited in its thickness, length, camber, and leading and trailing edge curvature. For example, the leading edge air deflector 475 may have aerodynamic thickness limitations as discussed above. In addition the using any of those thickness limits, the leading edge air deflector 475 may have a limited length based on a maximum thickness-to-chord length ratio of 0.19, or 0.15-0.23. The leading edge air deflector 475 may also have a maximum camber displacement ratio of 3.5, or 3.0-4.0.

Also for example, with the leading edge curvature being defined by its radius at its leading edge, the leading edge air deflector 475 may have a maximum aerodynamic thickness-to-leading edge radius ratio of 2.6, or from 2.4 to 2.8. Similarly, with the trailing edge curvature being defined by its radius at its trailing edge, the leading edge air deflector 475 may have a maximum aerodynamic thickness-to-trailing edge radius ratio of 3.5, or from 3.4 to 3.6 or from 3.2 to 3.8.

Figure 8:
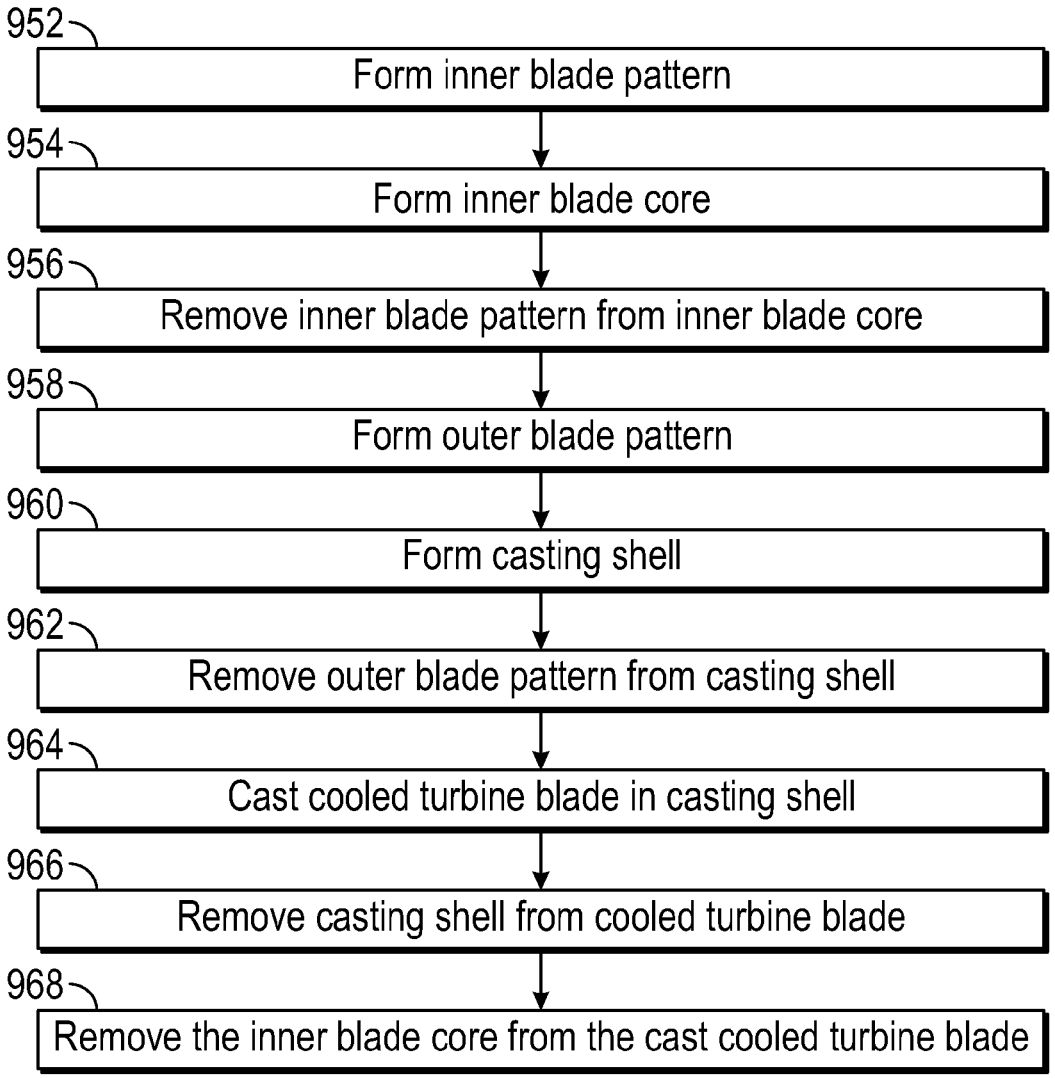
FIG. 8 is a flow chart of an exemplary method of manufacturing a cooled turbine blade.

FIG. 8 is a flow chart of an exemplary method of manufacturing a cooled turbine blade. In particular, a cooled turbine blade with a dense cooling fin array may be manufactured using the following steps, the above description, or a combination thereof. For example, a cooled turbine blade having all the features described above may be investment cast of a stainless steel and/or a superalloy using the following method. Embodiments of the method of manufacturing a cooled turbine blade will now be described with respect to the flow chart in FIG. 8, and FIGS. 9 through 11, which show structures used in the method.

The method may be conceptualized as forming a model or "pattern" of the structures/features internal to the cooled turbine blade, then forming a core (which serves as an internal mold for casting) around the pattern, then removing the pattern from the core (leaving a negative of the internal structures/features), then making a second pattern of the structures/features external to the cooled turbine blade, then forming a shell around the second pattern with core inside, then removing the second pattern from the shell (leaving an encased negative of both the internal and external structures/features), then casting liquid metal into the shell, and then removing the shell and the core. Additionally, each build stage may use a different material, which uses a different removal process.

The method of manufacturing a cooled turbine blade begins with step 952, forming an inner blade pattern. The inner blade pattern may be formed in a die, mold, or any conventional tool. For example the inner blade pattern may be formed using an injection molding process. In addition, the inner blade pattern may be made of a water soluble material, such as a water soluble polymer.

Figure 9:
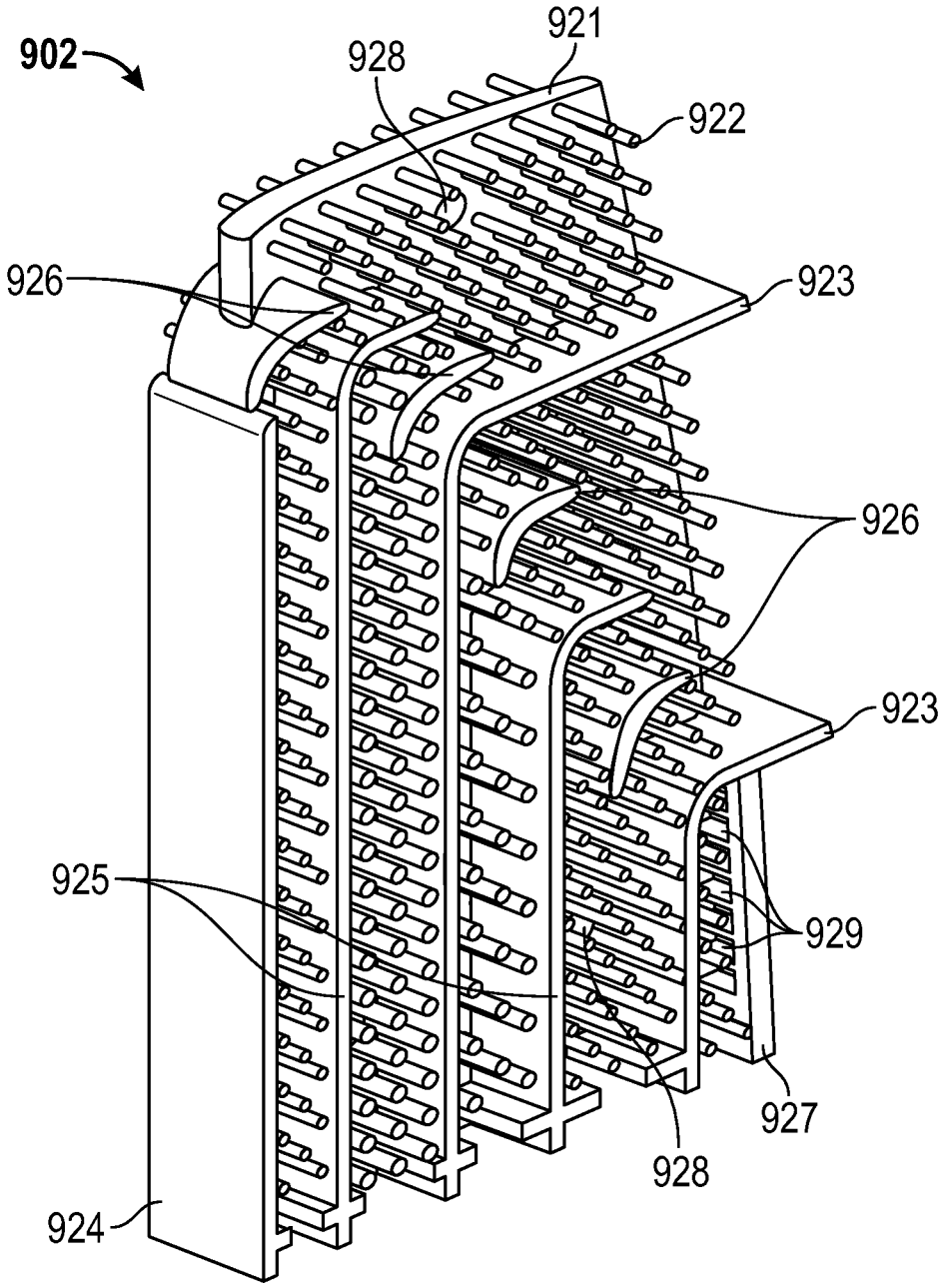
FIG. 9 is an isometric view of an exemplary inner blade pattern.

FIG. 9 is an isometric view of an exemplary inner blade pattern 902. Unless noted otherwise, the inner blade pattern 902 includes at least some or all of the structures/features internal to the cooled turbine blade to be manufactured, as described above. For example, according to one embodiment, the inner blade pattern 902 includes an inner spar 921 and a plurality of inner spar cooling fins 922 radiating outward on opposing sides of the inner spar 921, as described in greater detail above. As illustrated, the inner blade pattern 902 may further include one or more section dividers 923, a leading edge rib 924, one or more subsequent/downstream ribs 925, one or more air deflectors 926, and one or more trailing edge ribs 927, as described in greater detail above.

According to one embodiment, the plurality of inner spar cooling fins 922 of the inner blade pattern 902 form a dense cooling fin array as discussed above. For example, the plurality of inner spar cooling fins 922 radiating outward on opposing sides of the inner spar 921 may have a density of at least 80 fins per square inch on each opposing side of the inner spar 921. According to another embodiment, the plurality of inner spar cooling fins 922 forming may also be thin and long as discussed above. For example, the plurality of inner spar cooling fins 922 radiating outward on opposing sides of the inner spar 921 have a length at least twenty-five percent longer than the thickness of the inner spar and/or have a height-to-diameter ratio of 2-7.

According to another embodiment, tooling features may be incorporated into the inner blade pattern 902. In particular, one or more structures/features listed above may be extended and/or shaped to facilitate subsequent steps and/or handling. For example, one or more of the section dividers 923 may be extended aft of the inner blade pattern's trailing edge, beyond the contour of the part to be built. In particular, the one or more of the section dividers 923 may be extended so as to support, align, or otherwise hold the inner blade pattern 902 in place during subsequent casting steps.

Figure 10:
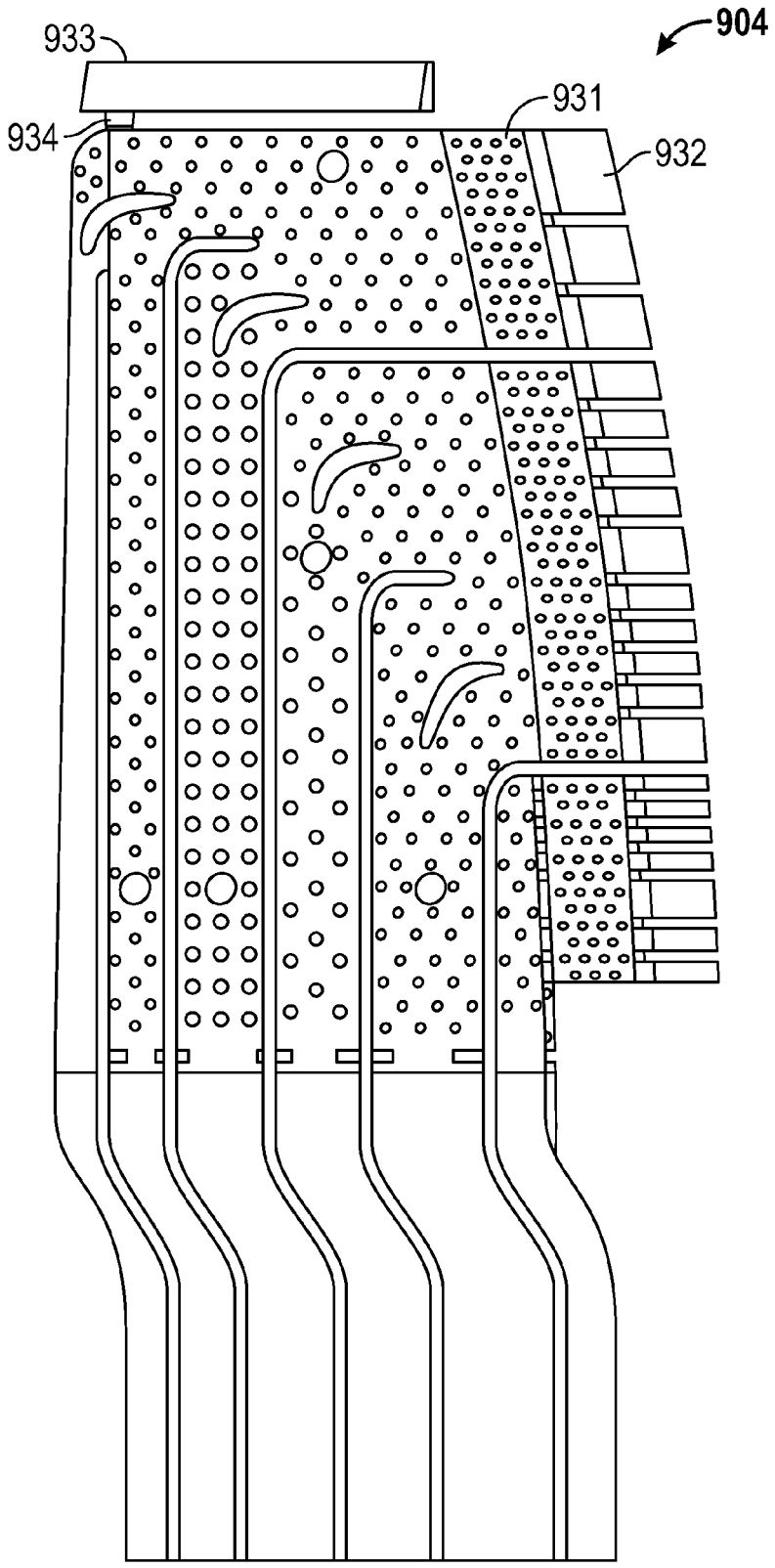
FIG. 10 is a side view of an exemplary inner blade core.

According to another embodiment, the inner spar 921 may include features configured for multiple purposes. In particular, inner spar 921 may include features configured for both manufacturing and for part performance. For example, the inner spar 921 may be formed with one or more inner spar pass-through holes 928. The inner spar pass-through hole 928 may be configured as alignment holes for one or more segments of the subsequently formed inner blade core 904 (FIG. 10). Also, the inner spar pass-through hole 928 may be configured so as "pin" or "tie together" each side of the subsequently formed inner blade core 904 during the manufacturing process and after the inner spar 921 is removed.

Additionally, the inner spar pass-through hole 928 may be configured such that the final part retains one or more holes corresponding to the inner spar pass-through hole 928. In particular, the one or more inner spar pass-through holes 928 may be positioned and/or sized according to the final performance of the part rather than merely tooling needs. As described above, one or more inner spar pass-through holes 928 may be positioned in each flow section for part performance, such as pressure balancing on each side of the inner spar 921. According to one embodiment, the inner spar pass-through hole 928 may also have an area at least three times that of the cross sectional area of the inner spar cooling fin 922.

Similarly, where the inner blade pattern 902 includes one or more trailing edge ribs 927 along at least one section of the a trailing edge of the inner spar 921, each trailing edge ribs 927 may include one or more openings 929. The one or more openings 929 may be configured both for part performance (as described in greater detail above) and for manufacturing. In particular, for manufacturing, the openings 929 may be configured to provide a passageway for a ceramic slurry to pass through during step 954 (FIG. 8—forming the inner blade core). Additionally, as discussed below, the one or more openings 929 may be configured to support the trailing edge section of the subsequently formed inner blade core 904 after step 956 (FIG. 8—removing the inner blade pattern from the inner blade core).

Returning to FIG. 8, the method of manufacturing a cooled turbine blade continues with step 954, forming an inner blade core 904 (FIG. 10). The inner blade core may be formed in a die, mold, or any conventional tool ("core mold"). In particular, the material which forms the inner blade core 904 may be applied to the inner blade pattern 902 (FIG. 9) while in a fluid state and while in the core mold or, engulfing structures/features of the inner blade pattern, and subsequently solidifying. When solidified, the inner blade core 904 will substantially encompass structures/features of the inner blade pattern 902, such as the inner spar 921 (FIG. 9) and the plurality of inner spar cooling fins 922 (FIG. 9) of the inner blade pattern. Surfaces such as attachment points, tips of extremities, alignment points, etc. may remain exposed.

The inner blade core 904 will be made of a material appropriate for multiple subsequent steps in the method. In particular, the inner blade core 904 will be made of a material that begins in liquid state, survives the casting process, and can be removed without damaging the cast part. Accordingly, the inner blade core 904 may be made from a refractory material such as a ceramic material. The refractory material may begin as a ceramic slurry that is then formed into the desired core shape and dried.

Once solidified, the inner blade core 904 (FIG. 10) may be still in a "green" state, or not fully cured. However, firing the inner blade core may be delayed until after step 956, removing the inner blade pattern 902 (FIG. 9) from the inner blade core 904 so as to avoid inner blade pattern expansion, and possible damage to the inner blade core 904. The dried inner blade core 904 may subsequently be fired from the "green" state to a final casting state once the inner blade pattern 902 has been removed but before step 958, forming the outer blade pattern.

According to one embodiment, step 954, forming the inner blade core 904 (FIG. 10), may include casting additional structures/features internal to the cooled turbine blade, which are not included in the inner blade pattern 902 (FIG. 9). In particular, the core mold may incorporate the additional internal structures/features as part of its permanent mold. For example, step 954, forming the inner blade core 904, may include casting a plurality of trailing edge cooling fin molds 931 (FIG. 10) and a cooling air outlet mold 932 (FIG. 10) into the inner blade core 904, using the core mold. Moreover, the core mold may have a different pull-plane than the that of the inner blade pattern 902, providing for the plurality of trailing edge cooling fin molds 931 and the cooling air outlet mold 932 to have a different angle than the internal structures/features (e.g., inner spar cooling fins 922) of radiating from the inner spar 921.

According to another embodiment, step 954 includes supporting the inner blade pattern 902 (FIG. 9) within the core mold. As discussed above, one or more structures/features of the inner blade pattern 902 may have been extended and/or shaped as "grab points" beyond the envelope of the part to be cast. As such, the one or more extended structures/features may used to aid in securing and positioning the inner blade pattern 902 as the inner blade core 904 is formed. Accordingly, the inner blade core 904 is formed substantially if not at least partially around the inner blade pattern 902.

According to another embodiment, one or more of the structures/features proximate the inner spar 921 (FIG. 9) may also be subdivided between the inner blade pattern 902 (FIG. 9) and the core mold. In particular, step 954 may include extending one portion of a structure/feature of the inner spar 921 formed by the inner blade pattern 902. As such, the extension may include another portion of the same structure/feature that is formed by the core mold itself. For example, the inner blade pattern 902 may include a portion of each inner spar cooling fin 922 (FIG. 9) that extends outward from the inner spar 921, and the core mold may then include the complementary portion to each inner spar cooling fin 922, extending inward toward the inner spar 921. According to one embodiment, approximately two thirds of the length of each inner spar cooling fin 922 may be formed by the inner blade pattern 902, with the remainder formed by the core mold.

FIG. 10 is a side view of an exemplary inner blade core 904. In particular, the inner blade core 904 is shown here with the inner blade pattern 902 removed for clarity and illustrative purposes. The inner blade core 904 itself generally represents the air flow passageways within the cooled turbine blade 440 (FIG. 4) to be manufactured. In particular, the solid portions of the inner blade core 904 take the form of the single-bend heat exchange path 470 (FIG. 4). As described in greater detail below, the single-bend heat exchange path 470 begins at a cooling air inlet 481 (FIG. 4) at a root end of the cooled turbine blade 440, ending at a cooling air outlet 471 (FIG. 4) at a trailing edge if the cooled turbine blade 440 and including a single bend between the cooling air inlet 481 and cooling air outlet 471 at the trailing edge.

Moreover, with the inner blade pattern 902 removed, the inner blade core 904 forms a mold of the inner structures/features to be cast within the cooled turbine blade 440, in other words leaving a mold of an inner portion of the cooled turbine blade. In particular, the vacancies within the inner blade core 904 represent the internal structures/features of the cooled turbine blade 440 (FIG. 4), described above. Moreover, the inner blade core 904 may include additional internal structures/features of the cooled turbine blade 440 not present in the inner blade pattern 902 (FIG. 9). For example, and as illustrated, the inner blade core 904 may include a plurality of trailing edge cooling fin molds 931 and a cooling air outlet mold 932.

According to one embodiment, the inner blade core 904 may also include a tip section 933. The tip section 933 represents a vacant area within the perimeter of the skin 460 (FIG. 3) and radially outward of the tip wall 461 (FIG. 4). The tip section 933 may be attached to the balance of the inner blade core 904 proximate its leading edge via a stub 934. The stub 934 will leave a void in the final casting. Accordingly, the void may be filled separately after step 964 (casting the cooled turbine blade in the shell).

Figure 11:
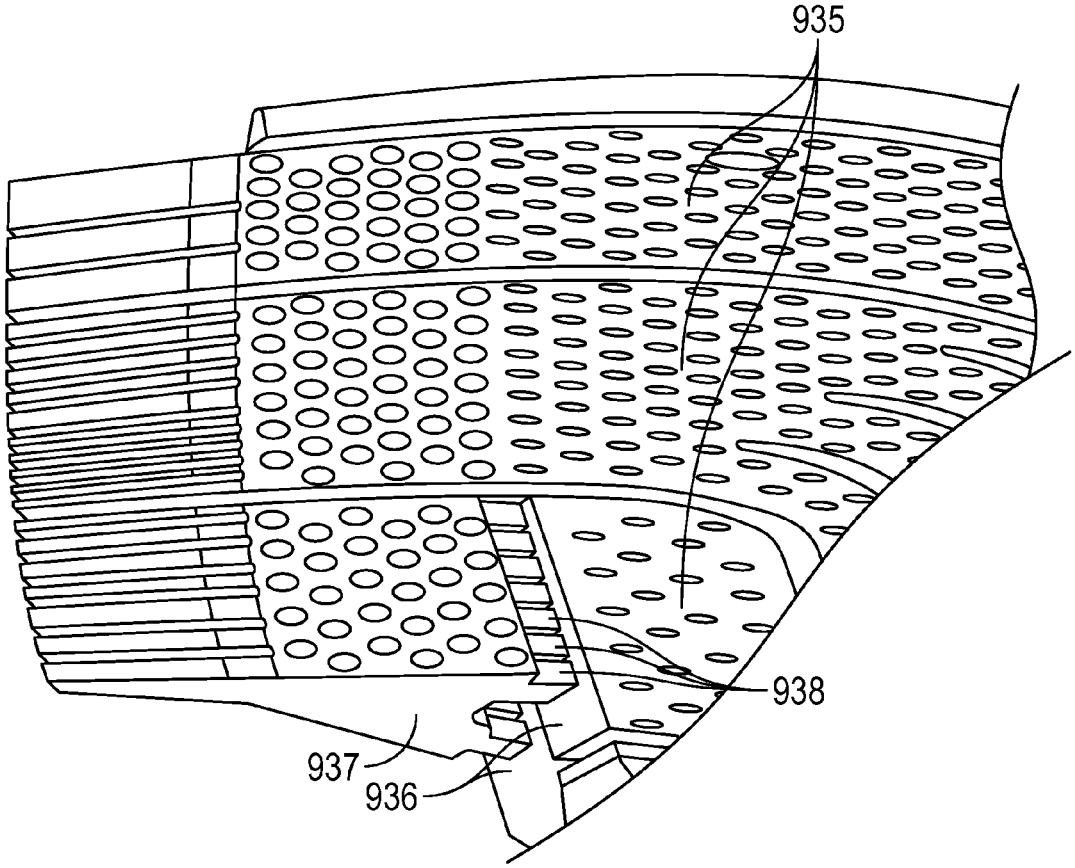
FIG. 11 is an isometric view of the inner blade core of FIG. 10.

FIG. 11 is an isometric view of the inner blade core 904 of FIG. 10. As illustrated, the inner blade core 904 generally represents the passageways for air flow within the cooled turbine blade 440 (FIG. 4) to be manufactured. In particular, the inner blade core 904 includes one or more discrete core sections 935, which represent air flow passageways that remain separated until exiting the cooled turbine blade 440 to be manufactured. Here, three core sections 935 are shown. As illustrated, each core section 935 includes a single bend and terminates at cooling air outlet mold 932 at the trailing edge.

As with the inner spar 921, the inner blade core 904 may include features configured for multiple purposes. In particular, the inner blade core 904 may include features configured for both manufacturing and for part performance. For example, where the inner blade pattern 902 includes one or more trailing edge ribs 927 (FIG. 9), the inner blade core 904 may be formed such that a "bridge" 938 is formed through each trailing edge rib 927. In particular, the inner blade core 904 may include two upstream regions 936 on each side of the inner spar 921 (FIG. 9). The two upstream regions 936 then merge into a single downstream region 937 via a plurality of discrete bridges 938. Accordingly, the plurality of discrete bridges 938 conform in shape to the plurality of openings 929 (FIG. 9) in each trailing edge rib 927 (FIG. 9) for part performance, while bridges 938 hold together and support the upstream regions 936 and the downstream region 937 in subsequent steps in the method.

Returning to FIG. 8, the method of manufacturing a cooled turbine blade continues with step 956, removing the inner blade pattern from the inner blade core. The inner blade pattern is a "fugitive" pattern, in that it is destroyed and removed at an intermediate point in the casting process. The inner blade pattern may therefore be made from a material amenable to said destruction, without damaging the subsequent core formed around it. For example, according to one embodiment the inner blade pattern may be water-soluble. Accordingly, the inner blade pattern may be dissolved from the inner blade core using water or an aqueous solution (i.e., using an aqueous-based dissolution process). Upon removing the inner blade pattern 902 from the inner blade core 904, the inner blade core 904 will be left with vacancies or cavities in the inner blade core 904 in the shape of the removed inner blade pattern 902 (i.e., the vacancies will be a "negative" of the inner blade pattern 902).

Next, the method includes step 958, forming an outer blade pattern. The outer blade pattern may be formed in a die, mold, or any conventional tool ("outer mold"). In particular, the outer blade pattern may be a fugitive or disposable pattern of the article to be cast, and may made around the inner blade core 904. For example, the outer blade pattern may formed by injection molding a fluid pattern material in an outer mold or enclosure, corresponding to the configuration of the article to be cast. That is, the fugitive outer blade pattern is an outward replica of the article to be cast. The outer blade pattern is made from a material amenable to thermal removal, such as a wax or other commonly used fugitive pattern material.

In forming an outer blade pattern, the outer blade pattern material (e.g., wax) is applied to the inner blade core 904 while in a fluid state and while in the outer mold. The outer blade pattern material subsequently solidified. Accordingly, the outer blade pattern substantially encompasses the inner blade core. In addition, the outer blade pattern replicates the outer features of the cooled turbine blade 440 (FIG. 3) including the airfoil 441 (FIG. 3) and the base 442 (FIG. 3). For example the outer features of the airfoil 441 may include the skin 460 and the tip wall 461, and the outer features of the base 442 may include the platform 443 and the blade root 480.

Next, the method includes step 960, forming a casting shell substantially encompassing the outer blade pattern, which substantially encompasses the inner blade core. In particular, the casting shell, made from a refractory stucco material, is applied to the outer blade pattern while in a fluid state, and subsequently solidified. For example, once the outer blade pattern is formed, the outer blade pattern may then be invested in a ceramic shell mold by repeatedly dipping the pattern in a ceramic slurry having ceramic flour carried in a liquid binder, draining excess slurry, stuccoing the slurry layer while it is wet with coarser ceramic particles or stucco, and then drying in air or controlled atmosphere until a desired thickness of a ceramic shell mold is built-up on the pattern. The initial ceramic slurry and stucco layers (e.g. the initial two layers) form what is called a facecoat of the shell mold for contacting the molten metal or alloy to be cast.

Next, the method includes step 962, removing the outer blade pattern from the casting shell. The outer blade pattern is made from a material amenable to thermal treatment (i.e., melting), without damaging or upsetting the casting shell or the inner blade core. After the outer blade pattern is removed, all that remains is an encased negative of both the internal and external structures/features of the cooled turbine blade 440 (FIG. 4) to be manufactured.

For example, once a casting shell of desired wall thickness is built up on the outer blade pattern, the outer blade pattern is removed from the casting shell by selectively melting out the outer blade pattern, leaving a ceramic shell mold having a plurality of mold cavities with the shape of each internal and external structures/features. One common pattern removal technique involves subjecting the from the casting shell/outer blade pattern/inner blade core assembly to a flash dewaxing step where the casting shell/outer blade pattern/inner blade core assembly is placed in an oven at elevated temperature to rapidly melt the outer blade pattern from the casting shell. Another technique for removing the outer blade pattern involves positioning the casting shell/outer blade pattern/inner blade core assembly in a steam autoclave where steam at elevated temperature and pressure is used to rapidly melt the outer blade pattern from the casting shell. Following outer blade pattern, the casting shell may be fired at elevated temperature to remove pattern residue and to develop appropriate mold strength for casting a molten metal or alloy.

Next, the method includes step 964, casting the cooled turbine blade 440 in the casting shell. In particular, the ceramic casting shell typically is cast with molten metal or alloy by pouring the molten material into a funnel-shaped pour cup of the casting shell and flowing the molten material by gravity down a sprue channel, through gates and into cavities of the casting shell and the inner blade core. The molten metal or alloy cools and solidifies in the mold to form the desired cooled turbine blade 440 within the casting shell. That is, the cast article assumes the shape of the mold cavities, which have the shape of the cooled turbine blade 440. According to one embodiment, the cooled turbine blade 440 is cast from a superalloy.

According to another embodiment casting includes flowing the molten material between the cavities representing the inner spar to be cast and the plurality of inner spar cooling fins to be cast. In particular, the cavity representing the inner spar limits the length of the flow path for the cavities representing the plurality of inner spar cooling fins to be cast. In addition, the cavity representing the inner spar provides an enlarged flow path. For example, flow of the molten material may be from the cavity representing the inner spar outward in opposite directions, from the cavity representing the skin inward, or any combination thereof.

Next, the method includes step 966, removing the casting shell from the cast cooled turbine blade 440. In particular, the casting shell mechanically removed, for example by destroying the casting shell. The cooled turbine blade 440 may still be connected to casting items such as solidified gates, sprue and pouring cup. As the ceramic casting shell is removed, the cast cooled turbine blade 440 may be cut or otherwise separated from the solidified gates and subjected to one or more finishing and inspecting operations may be performed.

Next, the method includes step 968, removing the inner blade core 904 from the cast cooled turbine blade 440. In particular, the inner blade core 904 is removed from within the cooled turbine blade 440 using a process, such as a chemical process, that the cooled turbine blade 440 is resistant to. For example, the inner blade core 904 may be removed from the cast cooled turbine blade 440 by dissolving the inner blade core 904 in an alkaline solution.

It is understood that the steps disclosed herein (or parts thereof) may be performed in the order presented or out of the order presented, unless specified otherwise. Likewise, it is understood that multiple steps may be combined or single steps may be subdivided.

INDUSTRIAL APPLICABILITY

The present disclosure generally applies to cooled turbine blades, and gas turbine engines having cooled turbine blades. The described embodiments are not limited to use in conjunction with a particular type of gas turbine engine, but rather may be applied to stationary or motive gas turbine engines, or any variant thereof. Gas turbine engines, and thus their components, may be suited for any number of industrial applications, such as, but not limited to, various aspects of the oil and natural gas industry (including include transmission, gathering, storage, withdrawal, and lifting of oil and natural gas), power generation industry, cogeneration, aerospace and transportation industry, to name a few examples.

Generally, embodiments of the presently disclosed cooled turbine blades are applicable to the use, assembly, manufacture, operation, maintenance, repair, and improvement of gas turbine engines, and may be used in order to improve performance and efficiency, decrease maintenance and repair, and/or lower costs. In addition, embodiments of the presently disclosed cooled turbine blades may be applicable at any stage of the gas turbine engine's life, from design to prototyping and first manufacture, and onward to end of life. Accordingly, the cooled turbine blades may be used in a first product, as a retrofit or enhancement to existing gas turbine engine, as a preventative measure, or even in response to an event. This is particularly true as the presently disclosed cooled turbine blades may conveniently include identical interfaces to be interchangeable with an earlier type of cooled turbine blades.

As discussed above, the entire cooled turbine blade may be cast formed. According to one embodiment, the cooled turbine blade 440 may be made from an investment casting process. For example, the entire cooled turbine blade 440 may be cast from stainless steel and/or a superalloy using a ceramic core or fugitive pattern. Accordingly, the inclusion of the inner spar is amenable to the manufacturing process. Notably, while the structures/features have been described above as discrete members for clarity, as a single casting, the structures/features may pass through and be integrated with the inner spar. Alternately, certain structures/features (e.g., skin 460) may be added to a cast core, forming a composite structure.

Embodiments of the presently disclosed cooled turbine blades provide for a lower pressure cooling air supply, which makes it more amenable to stationary gas turbine engine applications. In particular, the single bend provides for less turning losses, compared to serpentine configurations. In addition, the inner spar and copious cooling fin population provides for substantial heat exchange during the single pass. In addition, besides structurally supporting the cooling fins, the inner spar itself may serve as a heat exchanger. Finally, by including subdivided sections of both the single-bend heat exchange path in the airfoil, and the cooling air passageway in the base, the cooled turbine blades may be tunable so as to be responsive to local hot spots or cooling needs at design, or empirically discovered, post-production.

The disclosed single-bend heat exchange path 470 begins at the base 442 where pressurized cooling air 15 is received into the airfoil 441. The cooling air 15 is received from the cooling air passageway 482 in a generally radial direction. Additionally, all or part of the cooling air 15 leaving the leading edge chamber 463 may be redirected toward the trailing edge 447 by tip wall 461 and other cooling air 15 within the airfoil 441. The single-bend heat exchange path 470 is configured such that cooling air 15 will pass between, along, and around the various internal structures, but will generally flow in a ninety degree path as viewed from the side view (conceptually treating the camber sheet as a plane). Accordingly, the single-bend heat exchange path 470 may include some negligible lateral travel (i.e., into the plane) associated with the general curvature of the airfoil 441. Also, as discussed above, although the single-bend heat exchange path 470 is illustrated by a single representative flow line traveling through a single section for clarity, the single-bend heat exchange path 470 includes the entire flow path carrying cooling air 15 through the airfoil 441. Moreover, unlike other internally cooled turbine blades, the single-bend heat exchange path 470 is not serpentine, but rather has a single bend that efficiently redirects the cooling air 15 to the cooling air outlet 471 at the trailing edge 447 with a single turn. In particular, without a serpentine flow path, there are fewer opportunities for flow losses associated with multiple bends, allowing for a lower pressure cooling air supply.

In rugged environments, certain superalloys may be selected for their resistance to particular corrosive attack. However, depending on the thermal properties of the superalloy, greater cooling may be beneficial. Without increasing the cooling air supply pressure, the described method of manufacturing a cooled turbine blade provides for increasingly dense cooling fin arrays, as the fins may have a reduced cross section. In particular, the inner spar cuts the fin distance half, allowing for the thinner extremities, and thus a denser cooling fin array. Moreover, the shorter fin extrusion distance (i.e., from the inner spar to the skin rather than skin-to-skin) reduces challenges to casting in longer, narrow cavities. This is also complementary to forming the inner blade core with the inner blade pattern as shorter extrusions are used.

Although this invention has been shown and described with respect to detailed embodiments thereof, it will be understood by those skilled in the art that various changes in form and detail thereof may be made without departing from the spirit and scope of the claimed invention. Accordingly, the preceding detailed description is merely exemplary in nature and is not intended to limit the invention or the application and uses of the invention. In particular, the described embodiments are not limited to use in conjunction with a particular type of gas turbine engine. For example, the described embodiments may be applied to stationary or motive gas turbine engines, or any variant thereof. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. A method of manufacturing a turbine blade for use in a gas turbine engine, the method comprising:

forming an inner blade pattern with a water soluble material, the inner blade pattern including an inner spar and a plurality of inner spar cooling fins, the plurality of inner spar cooling fins radiating outward and away from each other on opposing sides of the inner spar, wherein the plurality of inner spar cooling fins have a density of at least 80 fins per square inch on each opposing side of the inner spar;

forming an inner blade core, the inner blade core substantially encompassing the inner spar and the plurality of inner spar cooling fins of the inner blade pattern;

removing the inner blade pattern from the inner blade core including dissolving the inner blade pattern with an aqueous solution and leaving a mold of an inner portion of the turbine blade;

forming an outer blade pattern, the outer blade pattern substantially encompassing the inner blade core, the outer blade pattern including an airfoil and a base, the airfoil including a tip wall, the base including a platform and a blade root;

forming a casting shell, the casting shell substantially encompassing the outer blade pattern;

removing the outer blade pattern from the casting shell;

casting the turbine blade in the casting shell;

removing the casting shell from the cast turbine blade; and removing the inner blade core from the cast turbine blade including dissolving the inner blade core in an alkaline solution.

2. The method of claim 1, wherein the plurality of inner spar cooling fins radiating outward and away from each other on opposing sides of the inner spar are formed to have a length at least twenty-five percent longer than the thickness of the inner spar.

3. The method of claim 1, wherein the inner spar is formed to include one or more inner spar pass-through holes.

4. The method of claim 1, wherein the inner blade pattern further includes a first trailing edge rib and a second trailing edge rib, the first and second trailing edge ribs along at least a section of a trailing edge of the inner spar, the first and second trailing edge ribs radiating on opposing sides of the inner spar outwardly from each other, and the first and second trailing edge ribs each including a plurality of openings configured to allow a ceramic slurry to pass through during forming the inner blade core; and wherein forming an inner blade core includes forming two upstream regions merged into a single downstream region via a plurality of discrete bridges, the two upstream regions separated from the single downstream region by the plurality of discrete bridges, the plurality of discrete bridges conforming in shape to the plurality of openings in the first and second trailing edge ribs.

5. The method of claim 1, wherein forming the inner blade core includes casting the inner blade core in a core mold; and wherein the core mold forms a plurality of trailing edge cooling fin molds and a cooling air outlet mold into the inner blade core.

6. The method of claim 1, wherein forming the inner blade core includes casting the inner blade core in a core mold, the core mold including a complementary portion to each inner spar cooling fin, each complementary portion extending inward toward the inner spar.

7. The method of claim 1, wherein forming the inner blade core includes forming the inner blade core in the shape of a single-bend heat exchange path, the single-bend heat exchange path beginning at a cooling air inlet at a root end of the turbine blade, ending at a cooling air outlet at a trailing edge of the turbine blade and including a single bend between the cooling air inlet and cooling air outlet at the trailing edge.

8. The method of claim 1, wherein casting the turbine blade in the casting shell includes flowing a molten material from a cavity formed by the inner spar of the inner blade pattern to a cavity formed by the plurality of inner spar cooling fins of the inner blade pattern.

9. The method of claim 1, wherein the inner blade core is made from a ceramic material;

wherein the outer blade pattern is made from a wax material;

wherein the casting shell is made from a refractory stucco material;

wherein removing the outer blade pattern from the casting shell includes melting away the outer blade pattern; and wherein removing the casting shell includes mechanically removing the casting shell.

10. A turbine blade made by the method of claim 1.

11. A gas turbine engine including a turbine blade made by the method of claim 1.

12. A method of manufacturing a turbine blade for use in a gas turbine engine, the method comprising:

forming an inner blade pattern, the inner blade pattern including an inner spar and a plurality of inner spar cooling fins, the plurality of inner spar cooling fins radiating outward on opposing sides of the inner spar, wherein the plurality of inner spar cooling fins have a length at least twenty-five percent longer than the thickness of the inner spar;

forming an inner blade core, the inner blade core being applied to the inner spar while in a fluid state and while in an enclosure, engulfing the plurality of inner spar cooling fins of the inner blade pattern, and subsequently solidifying; and removing the inner blade pattern from the inner blade core and leaving vacancies in the inner blade core in the shape of the inner blade pattern;

wherein the inner blade pattern further includes a first trailing edge rib and a second trailing edge rib, the first and second trailing edge ribs radiating on opposing sides of the inner spar outwardly from each other, and the first and second trailing edge ribs each including a plurality of openings configured to allow a ceramic slurry to pass through during forming the inner blade core.

13. The method of claim 12, wherein the plurality of inner spar cooling fins radiating outward on opposing sides of the inner spar are formed to have a density of at least 80 fins per square inch on each opposing side of the inner spar; and wherein the inner spar is formed to include one or more inner spar pass-through hole.

14. The method of claim 12, wherein the inner blade pattern is made from a water soluble material; and wherein removing the inner blade pattern includes dissolving the inner blade pattern with an aqueous solution.

15. The method of claim 12, further comprising:

forming an outer blade pattern, the outer blade pattern being applied to the inner blade core while in a fluid state and while in an enclosure, and subsequently solidified;

forming a casting shell, the casting shell being applied to the outer blade pattern while in a fluid state, and subsequently solidified, the casting shell substantially encompassing the outer blade pattern;

removing the outer blade pattern from the casting shell;

casting the turbine blade in the casting shell;

removing the casting shell from the cast turbine blade; and removing the inner blade core from the cast turbine blade.

16. The method of claim 15, wherein the inner blade core is made from a ceramic material;

wherein the outer blade pattern is made from a wax material;

wherein the casting shell is made from a refractory stucco material wherein removing the outer blade pattern from the casting shell includes melting away the outer blade pattern;

wherein removing the casting shell includes mechanically destroying the casting shell; and wherein removing the inner blade core from the cast turbine blade 40 includes dissolving the inner blade core in an alkaline solution.

17. The method of claim 15, wherein casting the turbine blade in the casting shell includes flowing a molten material from a cavity formed by the inner spar of the inner blade pattern to a cavity formed by the plurality of inner spar cooling fins of the inner blade pattern.

18. The method of claim 15, wherein casting the turbine blade in the casting shell includes casting a superalloy.

19. A turbine blade made by the method of claim 12.

20. A gas turbine engine including a turbine blade made by the method of claim 12.

21. A method of manufacturing a turbine blade for use in a gas turbine engine, the method comprising:

forming an inner blade pattern, the inner blade pattern including an inner spar and a plurality of inner spar cooling fins, the plurality of inner spar cooling fins radiating outward and away from each other on opposing sides of the inner spar, wherein the plurality of inner spar cooling fins have a density of at least 80 fins per square inch on each opposing side of the inner spar, wherein the inner blade pattern further includes a first trailing edge rib and a second trailing edge rib;

forming an inner blade core including forming two upstream regions merged into a single downstream region via a plurality of discrete bridges, the two upstream regions separated from the single downstream region by the plurality of discrete bridges, the plurality of discrete bridges conforming in shape to a plurality of openings in the first and second trailing edge ribs, the inner blade core substantially encompassing the inner spar and the plurality of inner spar cooling fins of the inner blade pattern;

removing the inner blade pattern from the inner blade core and leaving a mold of an inner portion of the turbine blade.

22. The method of claim 21, wherein the inner blade pattern further includes the first and second trailing edge ribs along at least a section of a trailing edge of the inner spar, the first and second trailing edge ribs radiating on opposing sides of the inner spar outwardly from each other, and the first and second trailing edge ribs each including the plurality of openings configured to allow a ceramic slurry to pass through during forming the inner blade core.

* * * * *